US007980545B2

(12) United States Patent
Yokomizo

(10) Patent No.: US 7,980,545 B2
(45) Date of Patent: Jul. 19, 2011

(54) SHEET INSERTION CONTROL UNIT/METHOD

(75) Inventor: Tsuyoshi Yokomizo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 198 days.

(21) Appl. No.: 12/401,467

(22) Filed: Mar. 10, 2009

(65) Prior Publication Data

US 2009/0230606 A1 Sep. 17, 2009

(30) Foreign Application Priority Data

Mar. 11, 2008 (JP) ..... 2008-061147

(51) Int. Cl.
*B65H 33/04* (2006.01)

(52) U.S. Cl. ..... 270/58.32; 270/58.23

(58) Field of Classification Search ..... 270/58.23, 270/58.31

See application file for complete search history.

(56) References Cited

U.S. PATENT DOCUMENTS

| | | | | |
|---|---|---|---|---|
| 6,908,078 | B2 * | 6/2005 | Suzuki et al. | 270/15 |
| 6,976,672 | B2 * | 12/2005 | Kawata | 271/9.11 |
| 7,080,830 | B2 * | 7/2006 | Suzuki et al. | 270/58.08 |
| 7,451,970 | B2 * | 11/2008 | Kawata | 270/58.14 |
| 7,651,081 | B2 * | 1/2010 | Yokobori et al. | 270/58.23 |
| 2002/0076231 | A1 * | 6/2002 | Akiba et al. | 399/82 |
| 2004/0190066 | A1 * | 9/2004 | Holzwarth et al. | 358/1.18 |
| 2008/0197556 | A1 * | 8/2008 | Nakagawa et al. | 270/58.32 |

FOREIGN PATENT DOCUMENTS

JP 2006-279150 A 10/2006

* cited by examiner

*Primary Examiner* — Patrick Mackey
(74) *Attorney, Agent, or Firm* — Canon U.S.A., Inc., IP Division

(57) ABSTRACT

An image forming apparatus having an image forming unit to form an image on a sheet, includes a sheet inserting unit configured to insert one or more of a first insertion sheet and a second insertion sheet at one or more predetermined insertion positions in a plurality of sheets, in a case where the plurality of sheets are output by the image forming unit. The image forming apparatus also includes a control unit configured to control the sheet inserting unit to prevent the sheet inserting unit from inserting both the first insertion sheet and the second insertion sheet at the same predetermined insertion position in the plurality of sheets.

12 Claims, 20 Drawing Sheets

SHEET INSERTION CONTROL UNIT/METHOD

BACKGROUND OF THE INVENTION

1. Field of the Invention

The present invention generally relates to an image forming apparatus configured to add an insertion sheet (slip sheet, partition sheet, etc.) at a predetermined position in a plurality of sheets on which images are formed, and further relates to a control method and a storage medium.

2. Description of the Related Art

In a conventional image forming apparatus that prints an image read by a scanner on a sheet, the apparatus may have a function for inserting a blank sheet or a different type of sheet to clearly indicate a breakpoint between sheets on which images are printed. For example, an insertion sheet (slip sheet, partition sheet, etc.) can be inserted according to a user's setting.

The slip sheet is an insertion sheet that may be inserted, according to a user's setting, at a predetermined position of a printed product that includes a plurality of sheets. The slip sheet can clearly indicate a breakpoint of the printed product. For example, the slip sheet can be used as a chapter sheet on which a chapter number is printed, or can be an insertion sheet on which an image read by a scanner is printed.

On the other hand, the partition sheet is an insertion sheet that may be inserted at a predetermined setting position, such as "page-to-page (i.e., between a specific page and another page)", "set-to-set (i.e., between a set of copies and another set of copies)", and "job-to-job (i.e., between a specific job and another job)", as determined by a user, to clearly indicate a breakpoint of a printed product.

As described above, the conventional image forming apparatus may allow users to set insertion of a plurality types of insertion sheets into a printed product. However, it can occur that when various setting methods are selectable for an insertion sheet, duplicative insertion sheets designated according to different methods may be added at the same insertion position in the plurality of image printed sheets. For example, if the partition sheet setting indicates insertion of a page-to-page partition sheet "between the second page and the third page" and the slip sheet setting similarly indicates insertion of a slip sheet "between the second page and the third page", duplicative insertion sheets (i.e, a pair of a partition sheet and a slip sheet) may be added at the same insertion position.

As another example, if the partition sheet setting indicates the "set-to-set" setting and the slip sheet setting indicates insertion of a slip sheet subsequent to the final page, duplicative insertion sheets (i.e., a pair of a partition sheet and a slip sheet) may be added to the same insertion position corresponding to the breakpoint of each set of copies. Also, if the partition sheet setting indicates the "job-to-job" setting and a user designates insertion of a slip sheet at the same insertion position as the job-to-job partition sheet, duplicative insertion sheets (i.e., a pair of a partition sheet and a slip sheet) may be added at the same insertion position.

In this manner, if the setting of a slip sheet and the setting of a partition sheet are duplicative, two insertion sheets are added at the same insertion position. However, the purpose of inserting an insertion sheet (e.g., a slip sheet or a partition sheet) is to clearly indicate each breakpoint of a printed product. In this respect, only one insertion sheet may be required to indicate the breakpoint. Therefore, if two or more insertion sheets are added at the same insertion position, an output product will include one or more useless insertion sheets. To solve this problem, as discussed in Japanese Patent Application Laid-Open No. 2006-279150, there is a conventional method for collectively deleting the slip sheet setting for document data to be printed or enabling users to change the content of the slip sheet setting.

However, if the method for collectively deleting all of the above-described slip sheet setting is used, it can occur that a slip sheet that is not intended to be deleted (e.g., a slip sheet on which a chapter number or an image is printed) may be deleted accidentally.

Also, if the method for enabling users to change the content of the slip sheet setting is used, the users may be required to not only identify a slip sheet to be deleted, but also change the content of the setting to delete the determined slip sheet. Thus, the method may force the users to perform relatively complicated settings.

SUMMARY OF THE INVENTION

According to an aspect of the present invention, an image forming apparatus having an image forming unit to form an image on a sheet, includes a sheet inserting unit configured to insert one or more of a first insertion sheet and a second insertion sheet at one or more predetermined insertion positions in a plurality of sheets, in a case where the plurality of sheets are output by the image forming unit. The image forming apparatus also includes a control unit configured to control the sheet inserting unit to prevent the sheet inserting unit from inserting both the first insertion sheet and the second insertion sheet at the same predetermined insertion position in the plurality of sheets.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to explain at least some of the principles of the invention.

FIGS. 7A to 7C illustrate example insertions of the slip sheet in a copy operation of an original, wherein FIG. 7A illustrates an example original including five pages, FIG. 7B illustrates an example original including a slip sheet inserted according to the first setting, and FIG. 7C illustrates an example of a slip sheet inserted according to the second setting.

FIGS. 9A and 9B illustrate example output products including partition sheets, wherein FIG. 9A illustrates an example output product including partition sheets inserted as job-to-job partition sheets, and FIG. 9B illustrates an example output product including partition sheets inserted as set-to-set partition sheets.

DETAILED DESCRIPTION OF THE EMBODIMENTS

Figure 1:
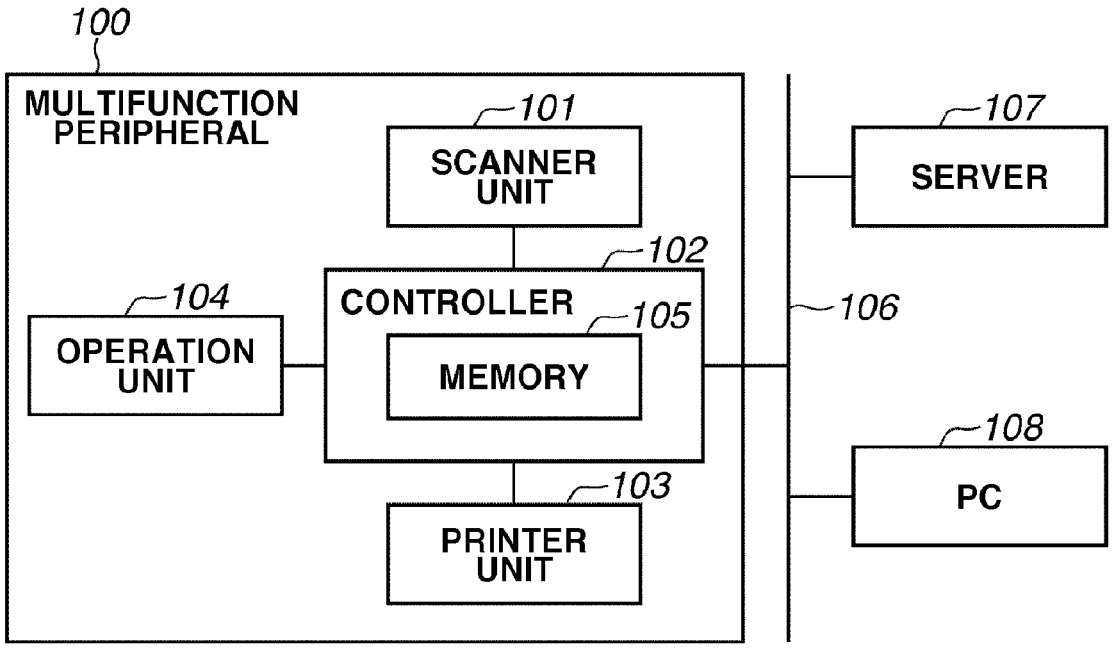
FIG. 1 is a block diagram illustrating an example configuration of an image forming system including an image forming apparatus according to a first exemplary embodiment of the present invention.

The following description of exemplary embodiments is illustrative in nature and is in no way intended to limit the invention, its application, or uses. It is noted that throughout the specification, similar reference numerals and letters refer to similar items in the following figures, and thus, once an item is described in one figure, it may not be discussed for the following figures. Various exemplary embodiments, features, and aspects of the invention will be described in detail below with reference to the drawings.

FIG. 1 is a block diagram illustrating an example configuration of an image forming system including an image forming apparatus according to a first exemplary embodiment of the present invention.

The image forming apparatus according to the first exemplary embodiment of the present invention may be, for example, a digital multifunction peripheral (hereinafter, simply referred to as "multifunction peripheral") 100 having COPY/PRINT/FAX functions. The multifunction peripheral 100 according to this embodiment includes a scanner unit 101 configured to read an image from an original and a controller 102 configured to perform image processing on the image read by the scanner unit 101 and store the processing image in a memory 105. The multifunction peripheral 100 may further include an operation unit 104 configured to enable a user to set print conditions when the image read by the scanner unit 101 is printed, and a printer unit 103 (i.e., an image forming unit) configured to read the image data from the memory 105 and perform image forming processing on a recording paper (i.e., sheet) according to the print conditions that have been set by the user via the operation unit 104.

The multifunction peripheral 100 according to this embodiment is connected via a network 106 to a server 107 that can manage image data and a personal computer (PC) 108 that can transmit a print job to the multifunction peripheral 100 to print the image data. The network 106 can be configured by Ethernet. The multifunction peripheral 100 can transmit the image data stored in the memory 105 to the server 107 via the network 106, and executes print processing on the image data managed by the server 107 according to an instruction received from the PC 108.

According to one aspect, the PC 108 converts a document created by a user using an application into PDL data, transmits a PDL job including the PDL data to the multifunction peripheral 100 via the network 106, and causes the multifunction peripheral 100 to execute print processing. Each of the server 107 and the PC 108 may be a general information processing apparatus, which includes a central processing unit (CPU), a random access memory (RAM), a read only memory (ROM), a hard disk, a monitor, a keyboard, and a mouse, and an interface (I/F) connected to the network 106 for communication with external devices. The monitor, the keyboard, and the mouse may cooperatively function as an operation unit.

Next, an example of detailed contents of the multifunction peripheral 100 illustrated in FIG. 1 are described with reference to FIG. 2.

Figure 2:
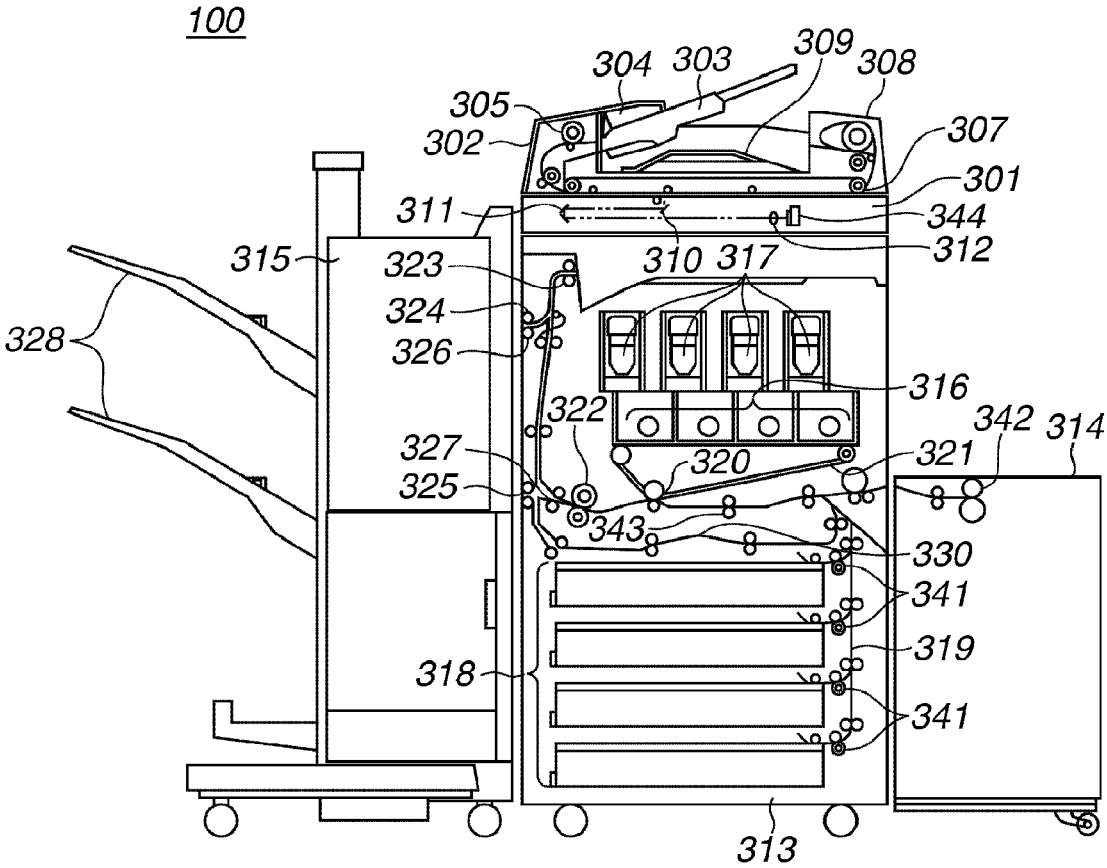
FIG. 2 illustrates an example configuration and functions of a multifunction peripheral as illustrated in FIG. 1.

FIG. 2 illustrates an example of a configuration of the multifunction peripheral 100 illustrated in FIG. 1.

In the example shown in FIG. 2, the multifunction peripheral 100 includes a scanner 301, a document feeder (DF) 302, a print engine 313 including four color drums to be used for print recording, a paper feeding deck 314, and a finisher 315. The scanner 301 corresponds to the scanner unit 101 illustrated in FIG. 1. The print engine 313 corresponds to the printer unit 103 illustrated in FIG. 1.

An example of a reading operation, to be performed by the scanner 301, is described below.

To cause the scanner 301 to read an image on an original, a user places the original on a document positioning plate 307 and closes the DF 302. After an opening/closing sensor (not illustrated) detects a closed state of the DF 302, a reflection type original size detection sensor (not illustrated) provided in the body of the scanner 301 detects the size of the original placed on the document positioning plate 307. In response to the detection of the size of the original, a light source 310 irradiates the original with light. The reflection light from the original is guided to a charge-coupled device (CCD) 344 via a reflection plate 311 and a lens 312. The CCD 344 converts the reception light into a digital signal and performs image processing on the converted digital signal to convert the digital signal into a laser recording signal. The converted laser recording signal is stored as image data in the memory 105 of the controller 102.

To cause the DF 302 to read an original, a user places the original in a face-up state on an original tray 303 of the DF 302. An original detection sensor 304 detects the original set on the original tray 303. In response to a detection signal of the detection sensor 304, an original paper feeding roller 305 and a conveyance belt 306 start rotating to convey the original to a predetermined position on the document positioning plate 307. Subsequently, the multifunction peripheral 100 performs processing similar to the above-described image reading operation performed on the document positioning plate 307, and stores read image data in the memory 105 of the controller 102.

After completing the image reading processing, the conveyance belt 306 rotates again to covey the original to the right. The original is discharged to an original discharge tray 309 via a conveyance roller 308. When two or more originals are present, the next original is fed from the left via the original paper feeding roller 305 to a reading position while the original on the document positioning plate 307 is conveyed and discharged to the right. The scanner 301 performs the above-described operations.

An example of a print operation, which can be performed by the print engine 313, is described below.

A plurality of cassettes 318 located at the lower part of the print engine 313 and the paper feeding deck 314 located next to the print engine 313 can store recording papers. To feed a recording paper from each cassette 318, a paper feeding roller pair 341 associated with a corresponding cassette 318 can convey the recording paper to a paper feeding conveyance path 319. To feed a recording paper from the paper feeding deck 314, a paper feeding roller pair 342 provided in the paper feeding deck 314 can convey the recording paper to the paper feeding conveyance path 319. The cassettes 318 and the paper feeding deck 314 can function as a paper feeding unit (paper feeding source) configured to feed a recording paper or a comparable sheet.

When the recording paper reaches the position corresponding to a registration roller pair 343, the recording paper is stopped once and then is conveyed again in synchronization with an intermediate transfer belt 321. If there is a recording paper to be transferred and positioned at the position corresponding to the registration roller pair 343, a recording paper to be used for the print on the next page can be fed from the cassette 318 or the paper feeding deck 314. In this case, a recording paper on the paper feeding conveyance path 319 is kept in a waiting state until conveyance of the recording paper stopped at the position corresponding to the registration roller pair 343 is started again. Performing the paper feeding operation in this manner can reduce the interval of images transferred to a plurality of recording papers and can improve the print productivity.

The recording signal (image data) temporarily stored in the memory 105 of the controller 102 is transferred to the print engine 313. A laser recording unit (not illustrated) converts the recording signal into recording laser beams of four (Yellow, Magenta, Cyan, and Black) colors. Then, a photosensitive member 316 of each color is irradiated with the corresponding recording laser beam. An electrostatic latent image is formed on the photosensitive member 316. Then, toner development processing is performed with a toner supplied from a toner cartridge 317. A visualized toner image is primarily transferred to the intermediate transfer belt 321.

The intermediate transfer belt 321 rotates at a constant speed in the clockwise direction. At the time when the intermediate transfer belt 321 reaches a predetermined position, the multifunction peripheral 100 starts conveyance of the recording paper in the waiting state at the position corresponding to the registration roller pair 343. More specifically, the predetermined position is a position where the front edge of the recording paper is conveyed to the secondary transfer position 320 when the front edge of the image transferred on the intermediate transfer belt 321 reaches a secondary transfer position 320. At the secondary transfer position 320, the toner image on the intermediate transfer belt 321 is transferred to the recording paper.

A fixing device 322 applies pressure and heat to the recording paper carrying the transferred toner image to fix the toner. The recording paper carrying the fixed toner image is conveyed along a discharge conveyance path and is discharged. The discharge place is a center tray 323 to which the recording paper is discharged in a face-down state, a discharge port 324 to which the recording paper to be conveyed to the finisher 315 is discharged after being switched back, or a side tray 325 to which the recording paper is discharged in a face-up state. The side tray 325 may be a discharge port that is usable only when the finisher 315 is not attached. Flappers 326 and 327 switch the conveyance path to guide the recording paper to respective discharge ports. When the multifunction peripheral 100 performs two-sided print processing, the flapper 327 switches the conveyance path after the recording paper has passed through the fixing device 322. Then, the recording paper is switched back and conveyed downward, and is again fed to the secondary transfer position 320 via a two-sided printed paper conveyance path 330. Thus, the two-sided operation may be accomplished.

Next, an example of an operation to be performed by the finisher 315 is described below.

The finisher 315 performs post-processing on the printed paper output from the print engine 313 according to a function designated by a user. More specifically, the finisher 315 can perform staple (one-portion or two-portion stitch), punch (two-hole or three-hole), and saddle stitch bookbinding processing. The finisher 315 may include two discharge trays 328. Each recording paper is guided from the discharge port 324 of the print engine 313 to one of two discharge trays 328 according to a user's setting, for example, for each of copy, print, and FAX functions.

The print engine 313 may be a color printer engine including four color drums or can be a color printer engine including a single drum, or can also be a monochrome printer engine. When a user uses a printer function of the multifunction peripheral 100, the printer driver allows the user to perform various settings (e.g., one or more of monochrome print/color print, paper size, 2UP print/4UP print/N-UP print, two-sided, stapler, punch, and saddle stitch bookbinding).

The printer driver further allows the user to set insertion of any additional sheet (e.g., one or more of a slip sheet, partition sheet, front cover, and back cover), which can be added at a designated position of recording papers to be printed. In the present exemplary embodiment, the slip sheet, the partition sheet, the front cover, and the back cover are collectively referred to as "insertion sheets" because these sheets can be inserted into a printed product. Each insertion sheet is not limited to a paper, and can also be for example, a film or other sheet-like member.

For example, the multifunction peripheral 100 may be capable of adding, at one or more predetermined insertion positions designated by a user, one or more insertion sheets into a set of recording papers to be printed. For example, the multifunction peripheral 100 may perform printing of images on ten recording papers, with the setting performed by a user including adding of an insertion sheet between two recording papers designated as the fifth and sixth pages. In this case, the multifunction peripheral 100 successively prints images of the first to fifth pages on recording papers, and discharges the printed recording papers to the discharge tray.

Then, the multifunction peripheral 100 feeds an insertion sheet, to be placed as a sheet following the fifth page, from another paper feeding cassette, and discharges the insertion sheet to the same discharge tray. The multifunction peripheral 100 further feeds recording papers to be placed as the sixth to tenth pages following the insertion sheet, and discharges the recording papers to the same discharge tray. In this manner, the multifunction peripheral 100 may perform sheet insertion processing for adding an insertion sheet at an insertion position that has been set by a user.

Next, details of an embodiment of the controller 102 illustrated in FIG. 1 are described below with reference to FIG. 3.

Figure 3:
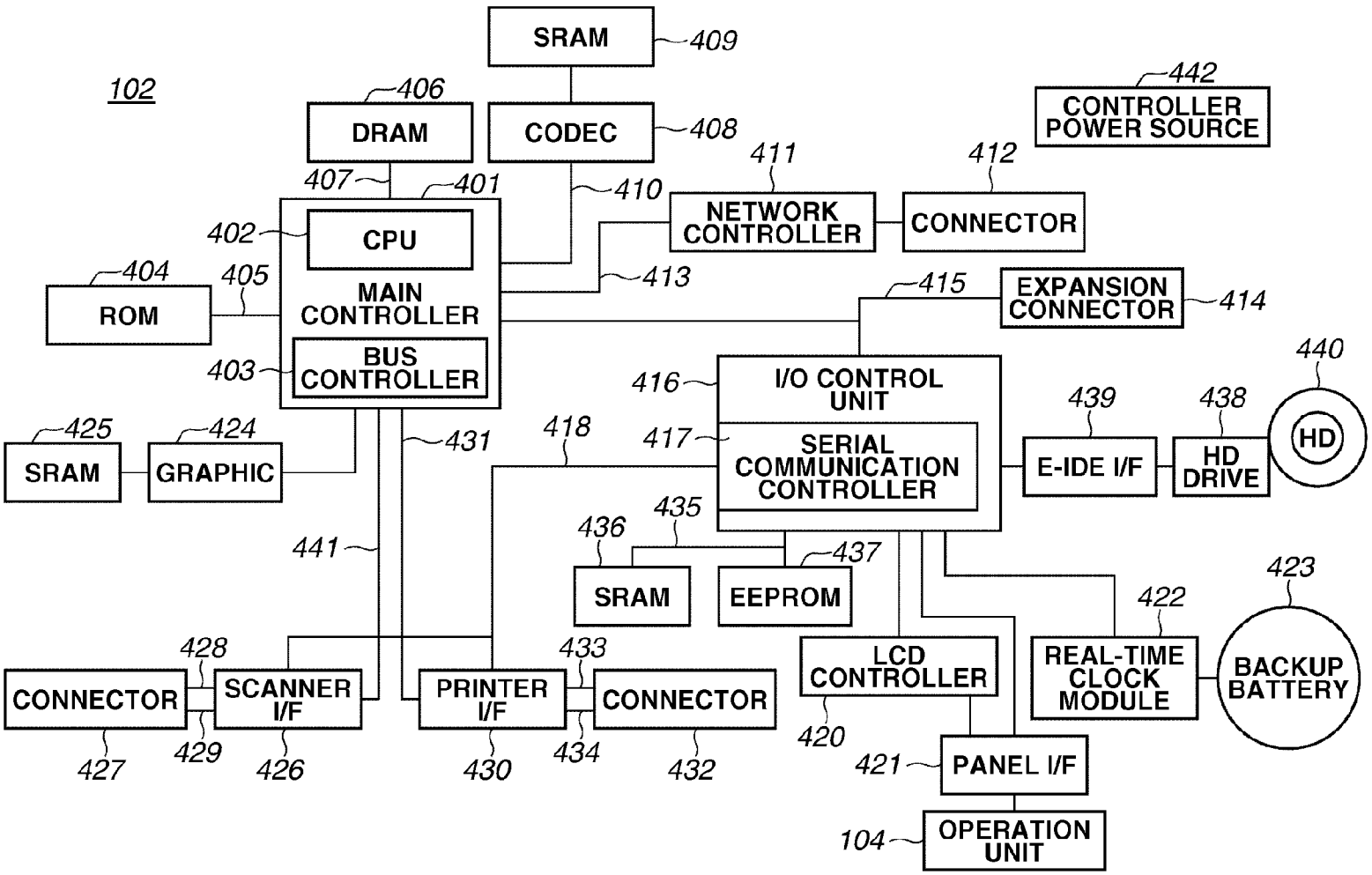
FIG. 3 is a block diagram illustrating an example of a hardware configuration of a controller as illustrated in FIG. 1.

FIG. 3 is a block diagram illustrating an example of a hardware configuration of the controller 102.

The main controller 401 according to this embodiment includes a central processing unit (CPU) 402, a bus controller 403, and various I/F controller circuits.

The CPU 402 and the bus controller 403 can control various operations performed by the controller 102. The CPU 402 operates based on a program read from a ROM 404 via a ROM I/F 405. For example, the processing described in the program may include interpreting page description language (PDL) data received from the PC 108 and developing raster image data. The CPU 402 performs software processing realizing these operations. The bus controller 403 may control transfer of data to be input/output via each I/F. For example, the bus controller 403 may perform arbitration in case of bus confliction and control transfer of DMA data.

A dynamic random access memory (DRAM) 406 may correspond to the memory 105 illustrated in FIG. 1, and may be connected to the main controller 401 via a DRAM I/F 407. The CPU 402 can use the DRAM 406 as a work area or an image data storage area.

A Codec 408 compresses raster image data stored in the DRAM 406 according to MH/MR/MMR/JBIG/JPEG methods, and expands (decompresses) the stored coded data into raster image data. The Codec 408 may be connected to the main controller 401 via an interface (I/F) 410. The bus controller 403 controls the data to be DMA transferred between the Codec 408 and the DRAM 406. The Codec 408 can use a static random access memory (SRAM) 409 as a temporary work area.

A graphic processor (Graphic) 424 may perform at least one of image rotation, image zooming, color space conversion, and binarization processing on raster image data stored in the DRAM 406. The graphic processor 424 may be connected to the main controller 401 via the I/F. The bus controller 403 controls the data to be DMA transferred between the graphic processor 424 and the DRAM 406. The graphic processor 424 can use a SRAM 425 as a temporary work area.

A network controller 411 may be connected to the main controller 401 via an I/F 413 and may be connected to the external network 106 via a connector 412.

A general-purpose high-speed bus 415 connects an expansion connector 414 and an I/O control unit 416 in this embodiment. An expansion board can be connected to the expansion connector 414. The general-purpose high-speed bus is generally a peripheral component interconnect (PCI) bus. The I/O control unit 416 can include two channels of asynchronization serial communication controllers 417, for transmission/reception of control commands to/from each CPU of the scanner unit 101 and the printer unit 103. The I/O control unit 416 may be connected to a scanner I/F 426 and a printer I/F 430 via an I/O bus 418.

The panel I/F 421, which may be connected to a liquid crystal display (LCD) controller 420, can include an I/F that performs a display using a liquid crystal screen of the operation unit 104 and a key input I/F that enables users to input instructions with hard keys and touch panel keys.

The operation unit 104 may include a liquid crystal display unit (not illustrated), a touch panel input apparatus attached on the liquid crystal display unit, and a plurality of hard keys. Input signals entered by a user with the touch panel or the hard keys may be transmitted to the CPU 402 via the above-described panel I/F 421. The liquid crystal display unit displays image data transmitted via the panel I/F 421. The liquid crystal display unit may perform a display of at least one of functions and image data relating to the operations performed by the multifunction peripheral 100. An example display by the operation unit 104 relating to the present invention is described below with reference to FIG. 6.

A real-time clock module 422 according to this embodiment has a function of updating/storing date and time managed in the device. A backup battery 423 may be provided for the real-time clock module 422. An E-IDE I/F 439 may be provided to connect an external storage apparatus. In the present exemplary embodiment, a hard disk (HD) drive 438 is connected to the E-IDE I/F 439 to store image data into a hard disk (HD) 440 or to read image data from the HD 440. Connectors 427 and 432 may be connected to the scanner unit 101 and the printer unit 103. The connector 427 can include an asynchronization serial I/F 428 and a scanner bus 429. The connector 432 can include an asynchronization serial I/F 433 and a scanner bus 434.

The scanner I/F 426 may be connected to the scanner unit 101 via the connector 427. The scanner I/F 426 may also be connected to the main controller 401 via a scanner bus 441. The scanner I/F 426 can have a function of performing predetermined processing on the image received from the scanner unit 101. Further, the scanner I/F 426 may have a function of outputting a control signal, which can be generated based on a video control signal supplied from the scanner unit 101, to the scanner bus 429. The bus controller 403 may control the transfer of data between the scanner bus 429 and the DRAM 406.

The printer I/F 430 may be connected to the printer unit 103 via the connector 432. The printer I/F 430 may also be connected to the main controller 401 via a printer bus 431. The printer I/F 430 can have a function of performing predetermined processing on the image data generated from the main controller 401, and a function of outputting the processed image data to the printer unit 103. Further, the printer I/F 430 may have a function of outputting a control signal, which can be generated based on a video control signal supplied from the printer unit 103, to the printer bus 431. The raster image data developed on the DRAM 406 may be DMA transferred, via the printer bus 431 and the video I/F 434, to the printer unit 103 under the control of the bus controller 403.

An SRAM 436 is a memory capable of storing storage contents under the electric power supplied from the backup battery 423, even after the main power source of the apparatus is turned off. The SRAM 436 may be connected to the I/O control unit 416 via a bus 435. An electrically erasable programmable read only memory (EEPROM) 437 may be connected to the I/O control unit 416 via the bus 435. A controller power source 442 can supply electric power to the main controller 401 and each functional unit.

An embodiment of the operation unit 104 enabling users to perform settings of various print conditions is described below with reference to FIGS. 4 and 5.

Figure 4:
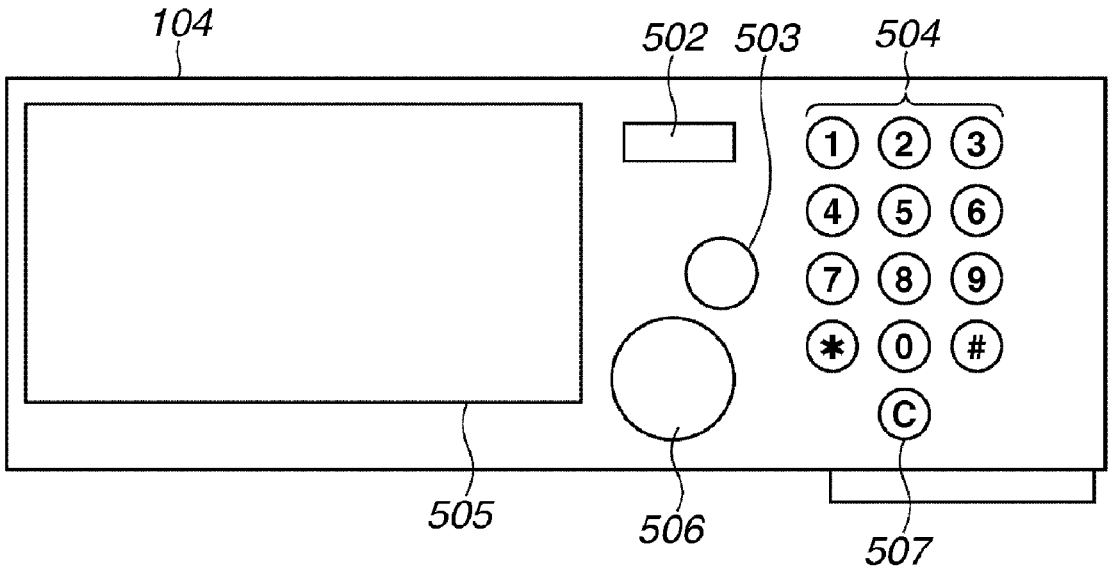
FIG. 4 illustrates an example of an appearance of an operation unit.

FIG. 4 illustrates an example of an appearance of the operation unit 104.

In the example shown in FIG. 4, the operation unit 104 is connected to the panel I/F 421 illustrated in FIG. 3. A reset key 502 is a key enabling users to reset a setting value that is already set. A stop key 503 is a key enabling users to cancel a job being currently executed. A group of ten keys 504 enable users to input numerical values (e.g., register keys).

A touch panel 505 is a touch panel type operation screen. More specifically, the touch panel 505 can display a screen, an example of which is illustrated in FIG. 5. A plurality of buttons on the touch panel 505 may enable users to perform various settings. A start key 506 is a key enabling users to start a job (e.g., such as a reading of an original). A clear key 507 is a key enabling users to clear the setting content.

Figure 5:
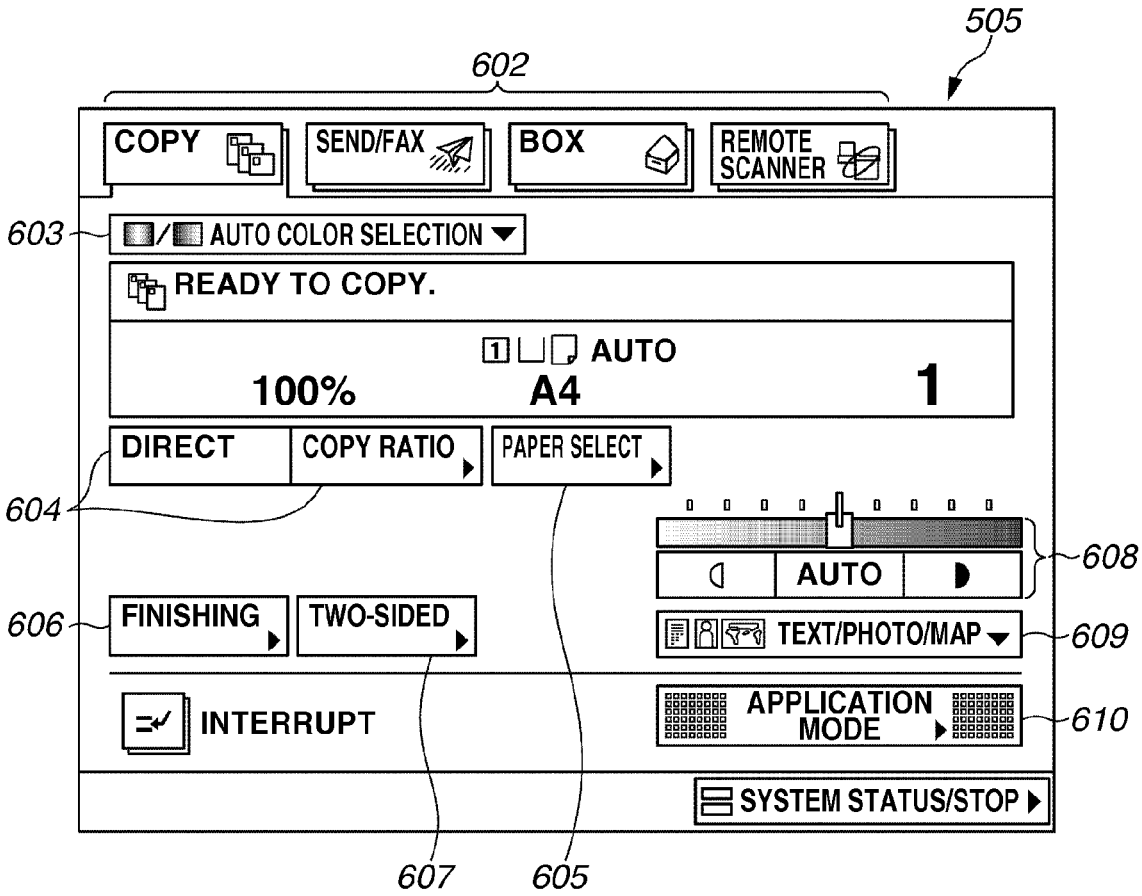
FIG. 5 illustrates an example of a screen displayed on a touch panel.

FIG. 5 illustrates the example screen, which can be displayed on the touch panel 505.

According to this example, a plurality of function tags 602 displayed on the upper part of the screen can function as buttons enabling users to select one of the functions. The function tags 602 illustrated in FIG. 5 correspond to a copy function, a send/FAX function, a BOX function, and a remote scanner function, and are arranged from left to right. In this example, the send/FAX function enables users to perform transmission of data, such as transmission of a FAX or an E-mail and transfer of data to a file server. The box (BOX) function enables users to store image data read by the scanner unit 101 into a hard disk of the device, and perform operation/printing of the stored data. The remote scanner function enables users to acquire a scanned image via the network 106 and store the scanned image in the PC 108. When one of the function tags 602 is selected, a detailed setting screen corresponding to the selected function is displayed. The example screen illustrated in FIG. 5 is an example of a detailed setting screen to be displayed when the copy function is selected.

The copy function screen as shown in this example includes a button 603 enabling users to select a color mode, a magnification designation button 604, a paper selection button 605, and a sorter button 606 enabling users to designate a finishing to be performed by a finisher (e.g., shift sort, staple sort, etc.). The copy function screen further includes a two-sided button 607 enabling users to designate two-sided print, a bar 608 enabling users to designate a density, a button 609 enabling users to select the type of an original, and an application mode button 610 enabling users to set other various application modes.

Figure 6:
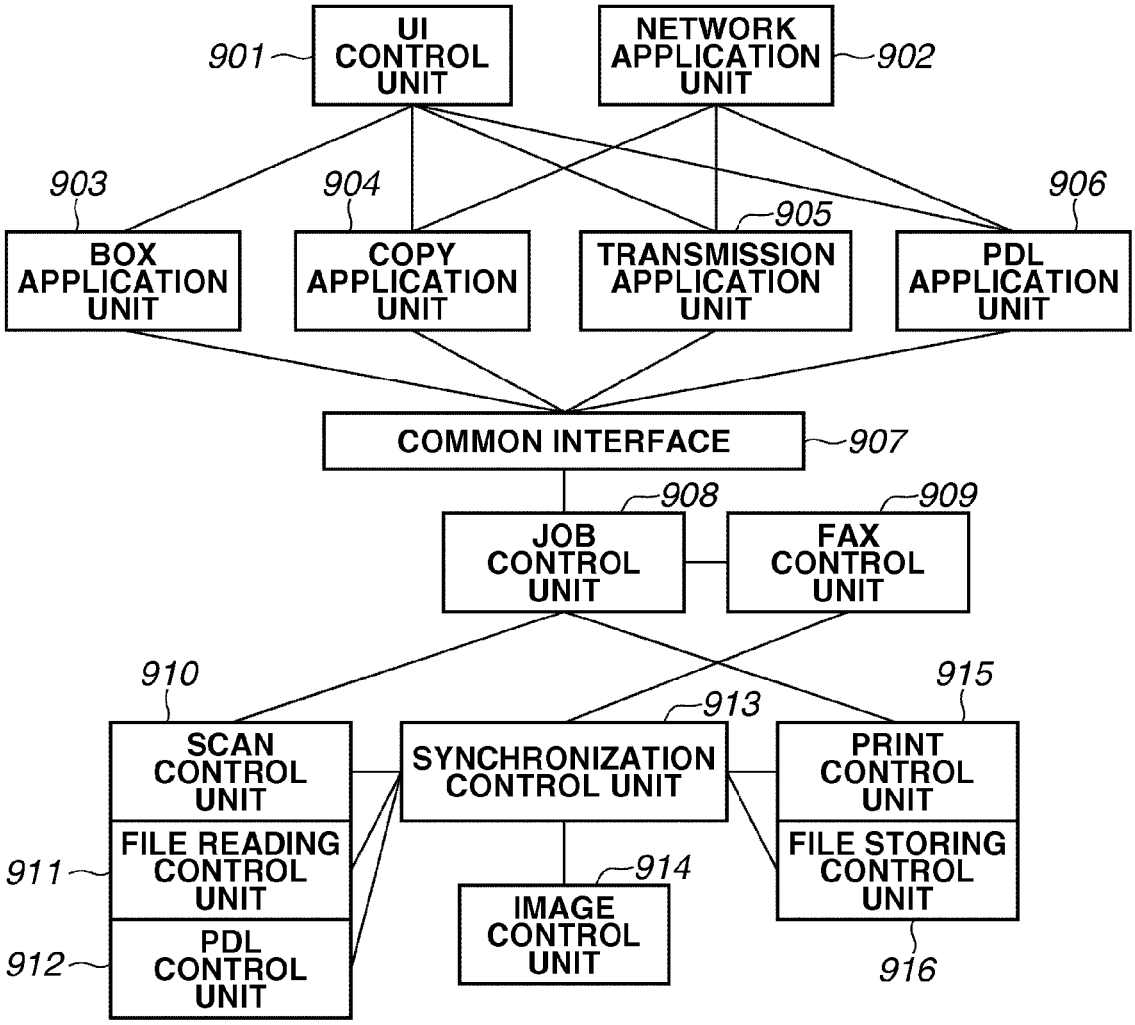
FIG. 6 illustrates an example of a configuration of control software to be executed by a central processing unit (CPU).

FIG. 6 illustrates an embodiment of the configuration of control software to be executed by the CPU 402.

According to this embodiment, a user interface (UI) control unit 901 controls the operation unit 104. A copy application unit 904 performs a copy operation in response to an instruction supplied from the UI control unit 901. A transmission application unit 905 performs a transmission operation in response to an instruction supplied from the UI control unit 901. A BOX application unit 903 performs a scan/print operation via a BOX screen in response to an instruction supplied from the UI control unit 901. A PDL application unit 906 receives PDL print data from a network application unit 902 and inputs a PDL print job.

A common interface 907 deals with device-dependent portions of the above-described device control unit. A job control unit 908 rearranges job information received from the common interface 907 and transmits the job information to a subordinate document processing unit.

First, an example of local copy software control processing is described below.

According to this example, in response to a user's instruction, the UI control unit 901 transmits a copy instruction and copy settings to the copy application unit 904. The copy application unit 904 transmits the information received from the UI control unit 901, via the common interface 907, to the job control unit 908 that performs device control. The job control unit 908 transmits job information to the scan control unit 910 and the print control unit 915. The scan control unit 910 sends a scanning request, via the scanner I/F 426, to the scanner unit 101. The scan control unit 910 also sends a scan-oriented image processing request to an image control unit 914 via a synchronization control unit 913.

The image control unit 914 performs setting for an image processing unit in the scanner I/F 426 according to an instruction from the scan control unit 910. After completing the settings, the image control unit 914 notifies of completion of scanning preparation via the synchronization control unit 913. Then, the scan control unit 910 instructs the scanner unit 101 to perform scanning processing. A scan image transfer completion notice may be transmitted to the image control unit 914 in response to an interrupt signal entered from hardware. In response to reception of a scan completion notice from the image control unit 914, the synchronization control unit 913 may transmit a scan completion notice to each of the scan control unit 910 and the print control unit 915.

The synchronization control unit 913 may send an instruction to the image control unit 914 to record a file of a compression image stored in the DRAM 406 to the HD 440, as illustrated for example in FIG. 3. The image control unit 914 stores an image on the memory (e.g., including a text/photo determination signal) to the HD 440 according to the instruction. The image control unit 914 further stores, in an SRAM, information relevant to the image, such as for example at least one of color determination/monochrome determination result, background removal level to be used for background removal processing, scan image (e.g., serving as image input source), and color space RGB.

According to this example, when the processing for storing the image in the HD 440 is completed and if a scan completion notice is received from the scanner unit 101, the image control unit 914 may notify the scan control unit 910 of completion of the file storing processing via the synchronization control unit 913. The scan control unit 910 returns a completion notice to the job control unit 908. The job control unit 908 returns the completion notice to the copy application unit 904 via the common interface 907. The print control unit 915 sends a print request to the printer unit 103 via the printer I/F 430, as illustrated for example in FIG. 3, at the time when an image is entered in the memory. The print control unit 915 may also send a print image processing request to the synchronization control unit 913. When the synchronization control unit 913 receives the request from the print control unit 915, the synchronization control unit 913 requests the image control unit 914 to perform image processing setting.

The image control unit 914 performs setting for an image processing unit in the printer I/F 430 according to the image-related information, and transmits a print preparation completion notice to the print control unit 915 via the synchronization control unit 913. The print control unit 915 transmits a print instruction to the print engine 313. A print image transfer completion notice may be transmitted to the image control unit 914 in response to an interrupt signal entered from hardware. In response to reception of a print completion notice from the image control unit 914, the synchronization control unit 913 transmits the print completion notice to the print control unit 915. In response to a discharge completion notice from the print engine 313, the print control unit 915 returns a completion notice to the job control unit 908. The job control unit 908 returns a completion notice to the copy application unit 904 via the common interface 907. The copy application unit 904 sends a job end notice to the UI control unit 901 to notify of completion of the scan and print processing.

According to this example, if the job is a remote copy scan job or a transmission job, a file storing control unit 916 may receive a request from the job control unit 908, instead of the print control unit 915. When the scanned image is completely stored in the HD 440, a storage completion notice may be received from the synchronization control unit 913. The storage completion notice is transmitted via the common interface 907 to the copy application unit 904, if the job is the remote copy, and to the transmission application unit 905, if the job is the transmission job. After the notification, the copy application unit 904 and the transmission application unit 905 may request the network application unit 902 to transmit the file stored in the HD 440.

In response to the request, the network application unit 902 may transmit the requested file to a remote device. The network application unit 902 receives the copy-related setting information from the copy application unit 904 when the job is started. The network application unit 902 performs transmission using a device-specific communication protocol if the job is the remote copy, and performs transmission using a standard file transfer protocol (e.g., FTP, SMB) if the job is the transmission job.

When a facsimile is transmitted, the facsimile transmission is instructed from the transmission application unit 905 to a FAX control unit 909 via the common interface 907 and the job control unit 908, after completing the file storage processing. The FAX control unit 909 negotiates with an opponent device via a modem, and requests the image control unit 914 to perform image processing (e.g., at least one of color→monochrome conversion, multi-valued/binary conversion, rotation, and zooming). A converted image is transmitted via the modem.

If a printer is designated as a transmission destination, the transmission application unit 905 may generate a print job instructing printing via the common interface 907. An operation performed in this case may be similar to that performed for a remote copy print job described below. If a BOX address in the device is designated as a transmission address, a file storage manager (not illustrated) may store the transmitted data in a file system of the device.

In the FAX reception, the FAX control unit 909 may receive an image via the modem and stores the received image as an image file in the HD 440. When the BOX application unit 903 receives notification of completion of the storage in the HD 440, the BOX application unit 903 transmits a reception print instruction to the job control unit 908 via the common interface 907. The subsequent processing is similar to that for an ordinary BOX print job, and is therefore being omitted.

According to this example, when the job is a remote copy print job, the network application unit 902 may store an image sent from a transmission side in the HD 440 and issue a print job to the copy application unit 904. The copy application unit 904 may send the print job to the job control unit 908 via the common interface 907. Compared to the local copy, the file reading control unit 911 receives the request from the job control unit 908 instead of the scan control unit 910. The file reading control unit 911 requests the image control unit 914, via the synchronization control unit 913, to develop the reception image from the HD 440 on the memory.

The image control unit 914 may rasterize (i.e., develop) an image on the memory, and may transmit a rasterization completion notice to the file reading control unit 911 and the print control unit 915 via the synchronization control unit 913. When the image is input to the memory, the print control unit 915 selects at least one of a paper feeding stage instructed by a job manager, and a paper feeding stage including the designated paper size, and sends a print request to the controller 102 via the printer I/F 430. If the designated paper size is "AUTO", the print control unit 915 may determine an appropriate paper feeding stage according to the image size, and send a print request to the controller 102. At the same time, the print control unit 915 may transmit a print image processing request to the synchronization control unit 913.

When the synchronization control unit 913 receives the request from the print control unit 915, the synchronization control unit 913 may request the image control unit 914 to perform print image processing setting. (In this case, for example, if there is not any paper having an optimum size, and if rotation of the image is to be performed, a rotation instruction may be additionally requested. In response to the rotation instruction, the image control unit 914 may cause the graphic processor 424 (see, e.g., FIG. 2) to rotate the image.) The image control unit 914 may perform a setting for the image processing unit in the printer I/F 430, and may transmit the print preparation completion notice to the print control unit 915 via the synchronization control unit 913. The print control unit 915 transmits a print instruction to the printer. A print image transfer completion notice may be transmitted to the image control unit 914 in response to an interrupt signal entered from hardware.

In response to reception of a print completion notice from the image control unit 914, the synchronization control unit 913 may transmit the print completion notice to the file reading control unit 911 and the print control unit 915. The file reading control unit 911 returns a completion notice to the job control unit 908. The print control unit 915 receives the discharge completion notice from the print engine 313 and returns a completion notice to the job control unit 908. The job control unit 908 may return a completion notice to the copy application unit 904 via the common interface 907. The copy application unit 904 may send a job end notice to the UI control unit 901 to notify of completion of the scan and print processing. A PDL control unit 912 and the print control unit 915 may cooperatively control a print of PDL data (e.g., at least one of LIPS, PostScript®, etc.).

According to one embodiment, the multifunction peripheral 100 may insert a slip sheet according to the following method.

The multifunction peripheral 100 is configured to print an image read by a scanner on a recording paper, and has a function for adding a blank insertion sheet or a different type of insertion sheet at a predetermined insertion position in the recording papers on which images are printed, to clearly indicate a breakpoint of recording papers. The slip sheet is an insertion sheet to be added, at a position designated by a user, to a printed product including a plurality of recording papers. In addition to the purpose of clearly indicating the breakpoint, the slip sheet can be used as, for example, at least one of a chapter sheet on which a chapter number is printed and an insertion sheet on which an image read by a scanner is printed. In one version the slip sheet can be, for example, a sheet having a different size compared to the recording papers positioned before and after the slip sheet.

On the other hand, the partition sheet may be an insertion sheet that is added to a predetermined insertion position, for example when a user selects at least one of "page-to-page (i.e., between a page and another page)", "set-to-set (i.e., between a set of copies and another set of copies)", and "job-to-job (i.e., between a job and another job)," to clearly indicate the breakpoint between pages, sets of copies and/or jobs. One or more of the slip sheet and the partition sheet can be stored in any one of the cassettes 318 and/or in the paper feeding deck 314, and can be inserted from these cassettes into a printed product during at least one of a copy operation of an original and in an image print operation.

The multifunction peripheral 100 can form an image on a recording paper based on image data of a scanned (i.e., read) original. The multifunction peripheral 100 can also add a slip sheet to these recording papers at a predetermined position according to, for example, one or more of a first setting for outputting a slip sheet on which an image is formed, and a second setting for outputting a blank slip sheet without forming any image thereon. A user can set these settings via the operation unit 104 and/or by using a printer driver installed on the PC 108.

Figure 7A:
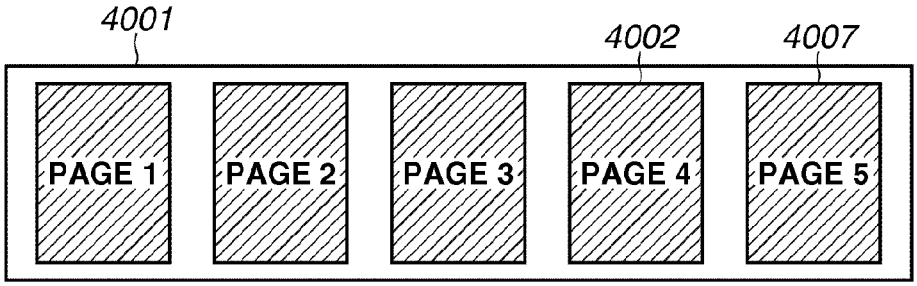
Figure 7B:
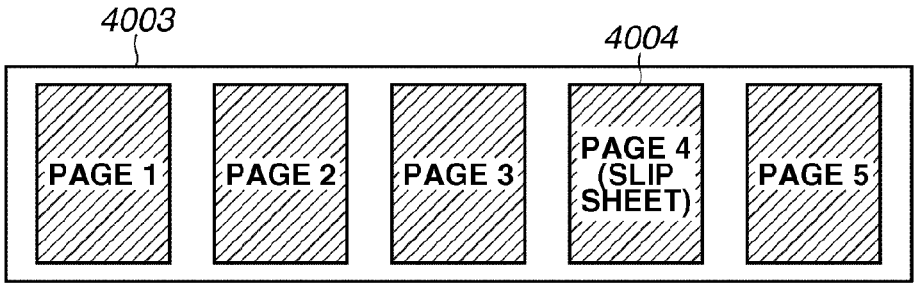
Figure 7C:
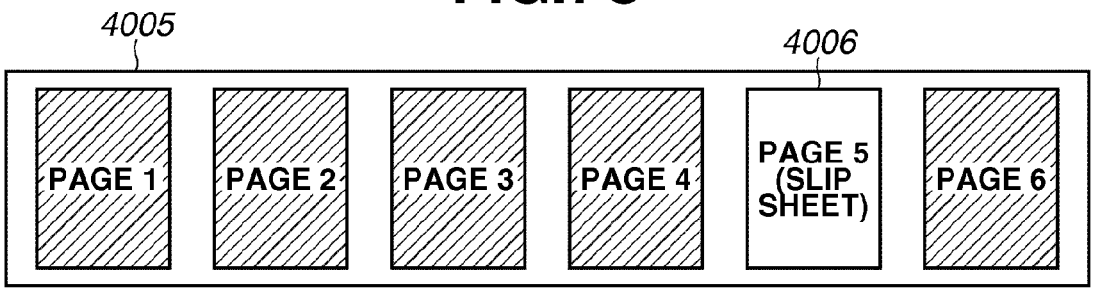

FIGS. 7A to 7C illustrate example insertions of the slip sheet in the copy of an original. FIG. 7A illustrates an example original including five pages. FIG. 7B illustrates an example original including a slip sheet inserted according to the first setting. FIG. 7C illustrates a slip sheet inserted according to the second setting.

In the examples as shown, a slip sheet is added to an example original 4001 including five pages, as illustrated in FIG. 7A, in the process of copying the original 4001. According to the first setting, as illustrated in FIG. 7B, a fourth page 4002 is copied (e.g., printed) as a slip sheet 4004. Therefore, an output product 4003 including five pages in total can be output. On the other hand, according to the second setting, as illustrated in FIG. 7C, a blank slip sheet 4006 is inserted between the fourth page 4002 and a fifth page 4007. As a result, an output product 4005 including six pages in total can be output.

In one version, the multifunction peripheral 100 can feed a paper to be used as the slip sheet from a cassette stage that is different from the cassette stage in which the recording papers and partition sheets are stored, so that a slip sheet having a different paper size can be inserted. In another version, the multifunction peripheral 100 can feed both the slip sheet and the partition sheet from the same cassette stage and insert them into a bundle of recording papers at predetermined page positions.

Figure 8A:
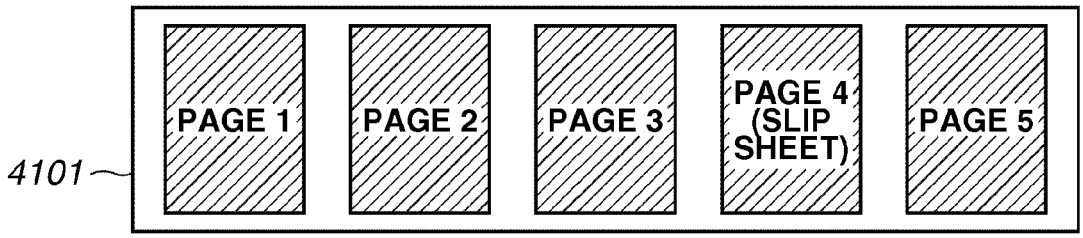
FIG. 8A illustrates an example output product including a slip sheet added to a plurality of recording papers according to the first setting, in which a sheet size of the slip sheet is identical to that of the recording papers.
Figure 8B:
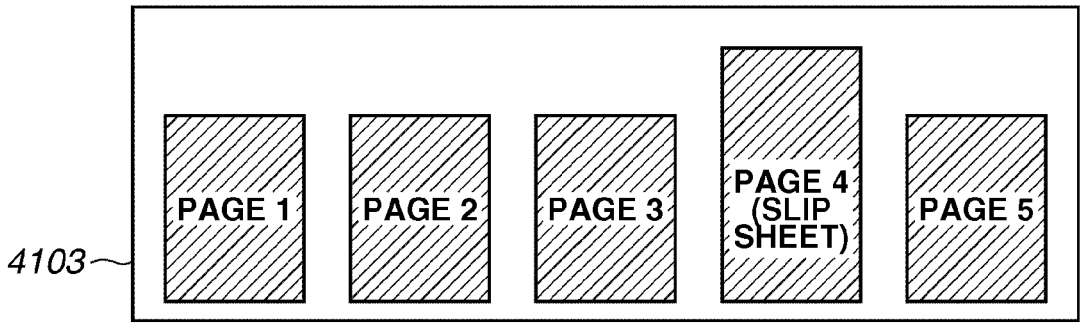
FIG. 8B illustrates an example output product including a slip sheet added to a plurality of recording papers according to the first setting, in which a sheet size of the slip sheet is different from that of the recording papers.

FIG. 8A illustrates an example output product including a slip sheet added to a plurality of recording papers according to the first setting, in which a sheet size of the slip sheet is identical to that of the recording papers. FIG. 8B illustrates an example output product including a slip sheet added to a plurality of recording papers according to the first setting, in which a sheet size of the slip sheet is different from that of the recording papers.

An output product 4101 illustrated in FIG. 8A includes a slip sheet that is identical in size to four recording papers. In this case, both the recording papers and the slip sheet can be fed from the same cassette stage. An output product 4103 illustrated in FIG. 8B includes a slip sheet that is different in size from four recording papers. In this case, the slip sheet may be fed from a cassette stage that is different from that of the recording papers.

Figure 9A:
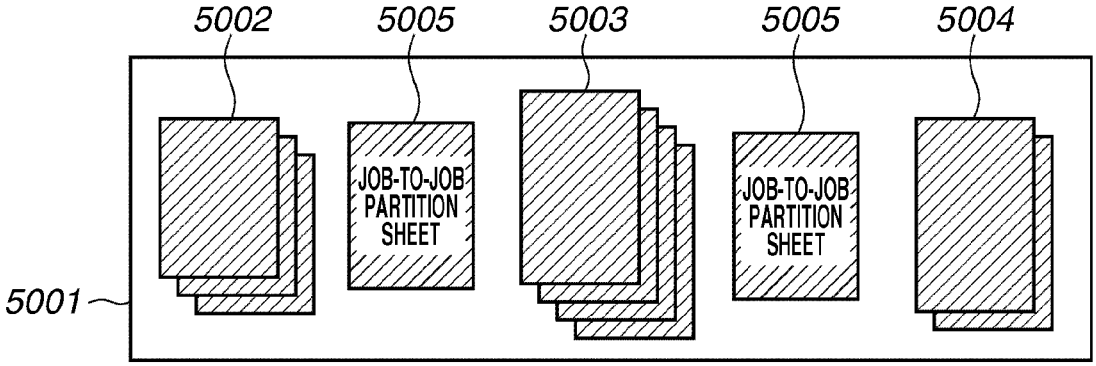
Figure 9B:
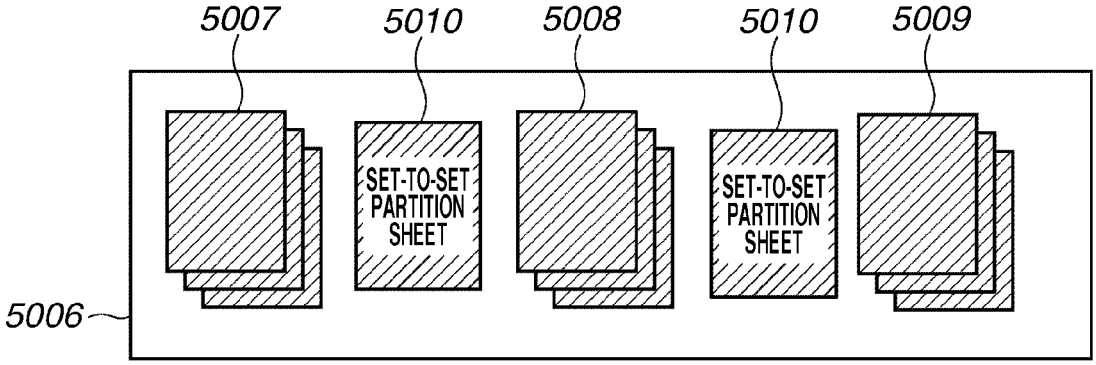

FIGS. 9A and 9B illustrate example output products including partition sheets. FIG. 9A illustrates an output product including partition sheets that are inserted as job-to-job partition sheets. FIG. 9B illustrates an output product including partition sheets that are inserted as set-to-set partition sheets.

In FIG. 9A, an output product 5001 includes two job-to-job partition sheets 5005 inserted as job partitions between three jobs 5002, 5003, and 5004. Setting of an output document can be performed on each of the job 5002, 5003, and 5004.

In FIG. 9B, an output product 5006 includes two set-to-set partition sheets 5010 inserted as document partitions between three sets 5007, 5008, and 5009.

Next, an example processing flow in the multifunction peripheral 100 that executes a job including a setting of adding a slip sheet and a partition sheet to an output product at the same page position is described below with reference to FIG. 10.

Figure 10:
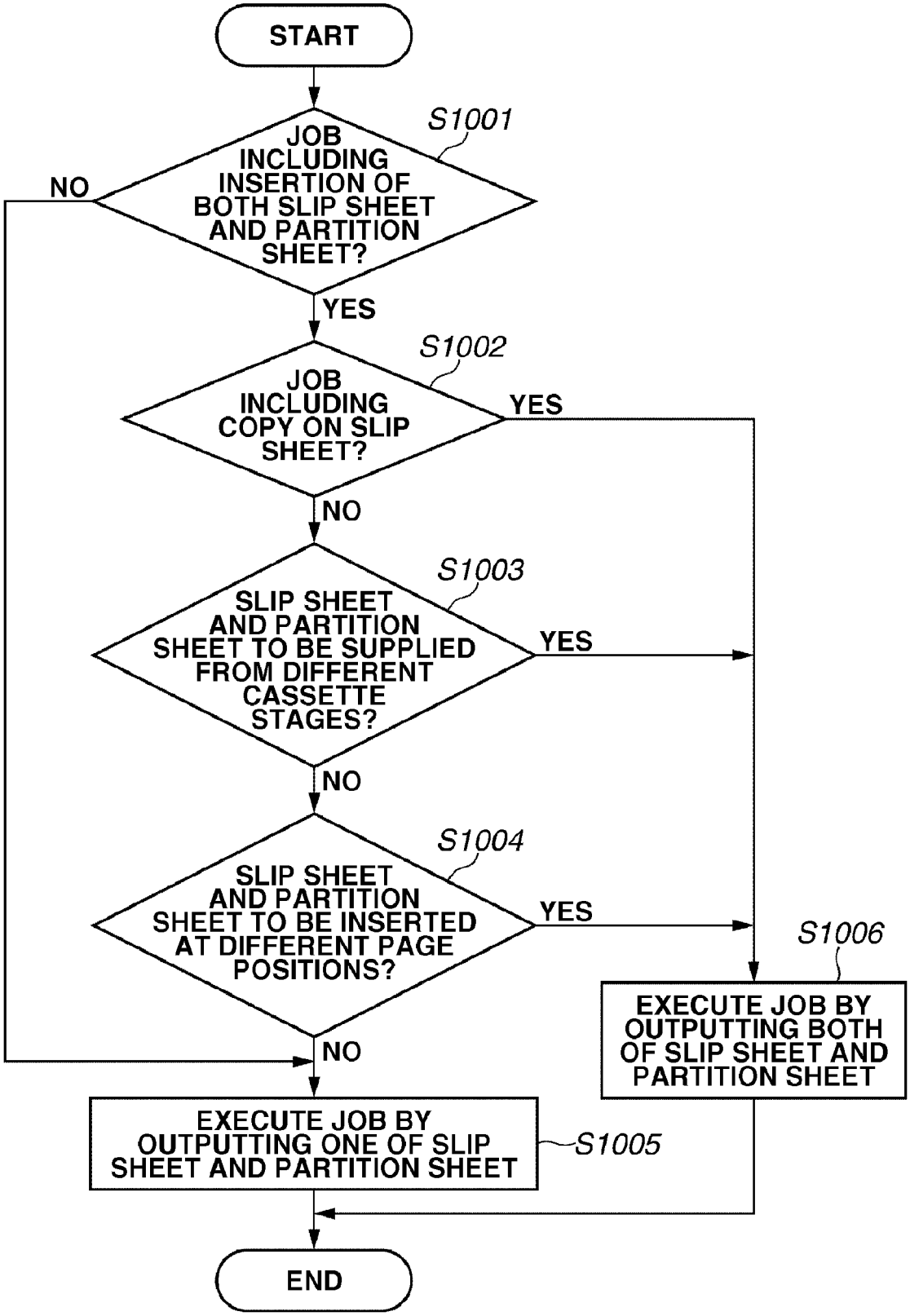
FIG. 10 is a flowchart illustrating example processing for executing a job including a setting of adding a slip sheet and a partition sheet to an output product at the same page position.

FIG. 10 is a flowchart illustrating an example of the processing flow for executing the job including the setting of adding a slip sheet and a partition sheet to an output product. Although the example processing illustrated in FIG. 10 relates to the job including the setting of adding a slip sheet and a partition sheet to an output product, the processing according to the present exemplary embodiment may also be applicable to a processing flow for executing a job including a setting of adding other type of paper (e.g., front cover or back cover) to an output product. To execute the example processing of the flowchart illustrated in FIG. 10, the CPU 402 of the controller 102 may read a program stored in the ROM 404 and execute the read program.

In step S1001, the controller 102 determines whether the job to be executed is a job including a setting of adding both a slip sheet and a partition sheet to an output product, based on job setting information. The job setting information can be set, for example, by a user using the PC 108 or via the operation unit 104. If the controller 102 determines that the job does not include any setting of adding both the slip sheet and the partition sheet to the output product (NO in step S1001), the processing proceeds to step S1005. In step S1005, the controller 102 may execute the job by outputting either the slip sheet or the partition sheet (i.e., not both), after which processing is ended.

If the controller 102 determines that the job includes the setting of adding both the slip sheet and the partition sheet to the output product (YES in step S1001), the processing proceeds to step S1002. In step S1002, the controller 102 determines whether the job to be executed is a job including a copy (e.g., print) on the slip sheet. If the controller 102 determines that the job includes the copy (e.g., print) on the slip sheet (YES in step S1002), the processing proceeds to step S1006. However, the determination processing in step S1002 is not limited to the slip sheet. If two or more types of papers can be added to the output product, the controller 102 can also determine whether the job to be executed is a job including a copy (e.g., print) on each type of paper.

In step S1006, the controller 102 executes the job by outputting both the slip sheet and the partition sheet, because blank papers are not continuously output even when the job includes the setting of adding the slip sheet and the partition sheet to the output product at same page position, after which processing is ended.

If the controller 102 determines that the job does not include any copy (e.g., print) on the slip sheet (NO in step S1002), the processing proceeds to step S1003. In step S1003, the controller 102 determines whether the slip sheet and the partition sheet are fed from different cassette stages (e.g., storage places). In the determination processing in step S1003, the storage places are not limited to the cassettes 318, and can also include paper feeding stages of the paper feeding deck 314 and a manual tray.

If the controller 102 determines that the slip sheet and the partition sheet are fed from different cassette stages (YES in step S1003), the processing proceeds to step S1006. In step S1006, the controller 102 executes the job by outputting both the slip sheet and the partition sheet. The slip sheet and the partition sheet may be discriminated from each other in type (paper size, paper type, etc.) even if the slip sheet and the partition sheet are blank papers, after which processing is ended.

If the controller 102 determines that the slip sheet and the partition sheet are fed from the same cassette stage (NO in step S1003), the processing proceeds to step S1004. In step S1004, the controller 102 determines whether the slip sheet and the partition sheet are added to the output product at different page positions.

If the controller 102 determines that the slip sheet and the partition sheet are added to the output product at different page positions (YES in step S1004), the processing proceeds to step S1006. In step S1006, the controller 102 executes the job by outputting both the slip sheet and the partition sheet, after which processing is ended. If the controller 102 determines that the slip sheet and the partition sheet are added to the output product at the same page position (e.g., the same predetermined insertion position) (NO in step S1004), the processing proceeds to step S1005. In step S1005, the controller 102 executes the job by outputting either the slip sheet or the partition sheet, after which processing is ended.

The above-described job can be instructed by the user via the operation unit 104 of the multifunction peripheral 100 or from the PC 108 via the network 106.

In the present exemplary embodiment, the processing in step S1003 may be performed to determine whether the slip sheet and the partition sheet are fed from the different cassette stages (i.e., different storage places such as different paper feeding sources). However, in step S1003, the controller 102 can also determine whether the slip sheet and the partition sheet are identical to each other in sheet size.

For example, the controller 102 may identify the size of at least one of the slip sheet and the size of the partition sheet based on the job setting information. If the controller 102 determines that the size of the slip sheet is identical to the size of the partition sheet, the controller 102 may execute the job by outputting both the slip sheet and the partition sheet in the processing of step S1006.

If the controller 102 determines that the size of the slip sheet is different from the size of the partition sheet, the controller 102 may execute the job by outputting either the slip sheet or the partition sheet in the processing of step S1004. The processing for determining whether the size of the slip sheet is identical to the size of the partition sheet can prevent duplicative insertion sheets (i.e., the slip sheet and the partition sheet) from being output even in a case where the slip sheet and the partition sheet are stored in different paper feeding cassettes that are identical in size.

According to the above-described first exemplary embodiment, when an image read from an original is formed (e.g., printed) on a recording paper, it is determined whether the job includes a setting of adding a slip sheet and a partition sheet (i.e., insertion sheets different from the recording papers) to an output product. If the job includes the setting of adding the slip sheet and the partition sheet to the output product, it is then determined whether the job includes a setting of performing a copy (e.g., image formation) on the slip sheet. If the job includes the setting of performing a copy (e.g., image formation) on the slip sheet, then insertion of the slip sheet and the partition sheet at the same predetermined insertion position may be permitted. If the job does not include any setting of performing the copy (e.g., image formation) on the slip sheet, it may be further determined whether the slip sheet and the partition sheet are fed from different cassette stages.

Then, if it is determined that both the slip sheet and the partition sheet are fed from the same cassette stage and these insertion sheets are added to the output product at the same page position, insertion of either the slip sheet or the partition sheet is cancelled. Therefore, the present exemplary embodiment can automatically prevent both the slip sheet and the partition sheet from being added to a plurality of image printed sheets at the same predetermined page position, without requiring users to perform troublesome settings. The output product can thus be obtained as intended.

An image forming apparatus according to the second exemplary embodiment of the present invention is similar to the image forming apparatus described in the first exemplary embodiment in their configurations (e.g., refer to FIGS. 1 to 6). Constituent components and portions that are similar to those described in the first exemplary embodiment are denoted by the same reference numerals, and their descriptions are not repeated. Features different from those of the above-described first exemplary embodiment are described below.

The multifunction peripheral 100 according to the first exemplary embodiment may execute the job by canceling one of the slip sheet and the partition sheet and outputting the other of the slip sheet or the partition sheet, when the slip sheet and the partition sheet are set to be inserted at the same page position, and when no copy is formed on the slip sheet, and if the storage place of the slip sheet is identical to the storage place of the partition sheet.

However, it may be the case that a user prefers a continuous output of the slip sheet and the partition sheet. When the slip sheet and the partition sheet are continuously output, the insertion sheet to be output first can be the slip sheet or the partition sheet.

The multifunction peripheral 100 according to the second exemplary embodiment enables users to select and set an output method even when the job to be executed includes a setting of inserting a slip sheet and a partition sheet at the same page position.

Example control processing according to the second exemplary embodiment of the present invention, in outputting a job including a setting of inserting both the slip sheet and the partition sheet at the same page position, is described below with reference to FIGS. 11 to 14.

Figure 11:
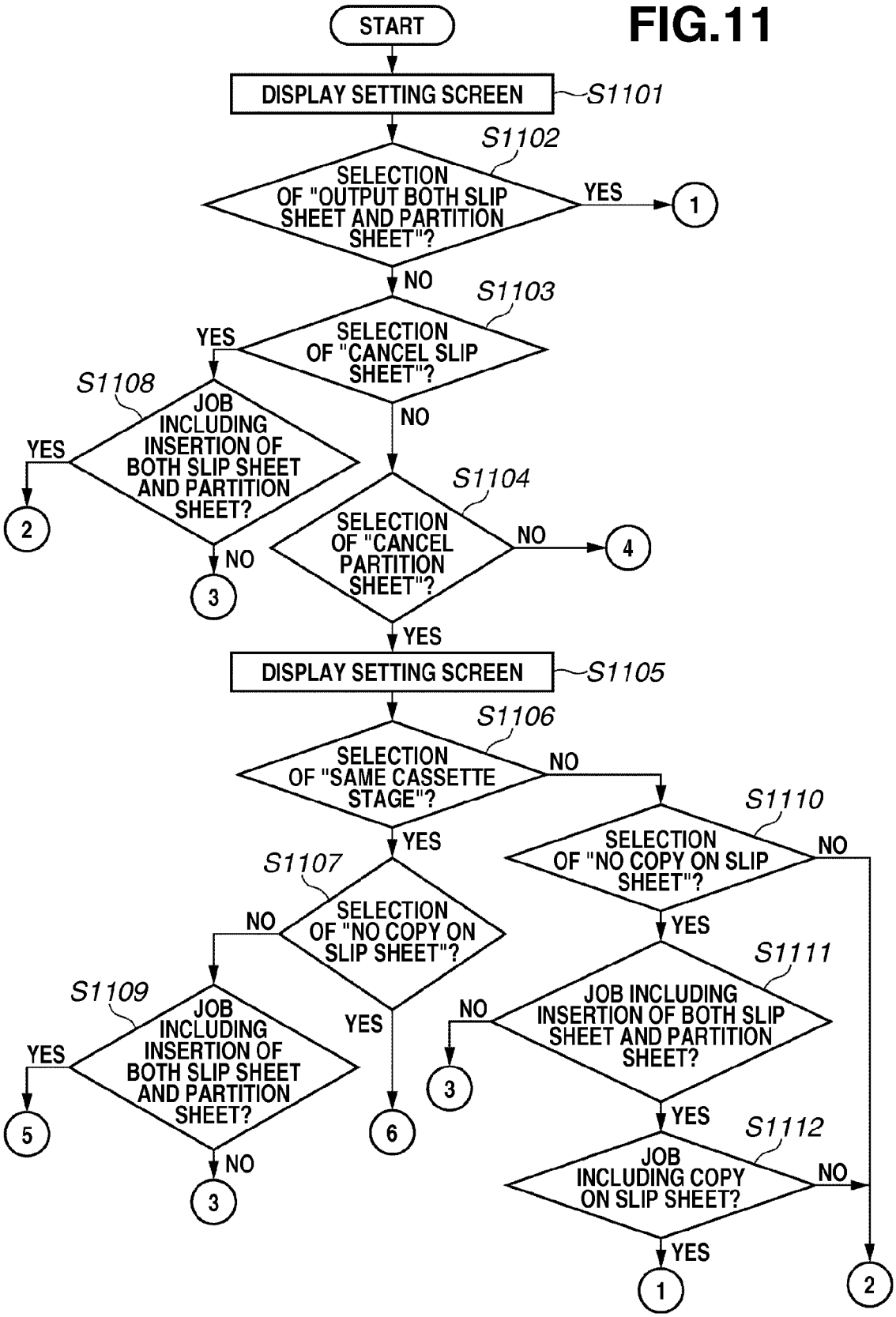
FIG. 11 is a flowchart illustrating example processing for executing a job including a setting of adding the slip sheet and the partition sheet to an output product at the same page position according to a second exemplary embodiment of the present invention.
Figure 12:
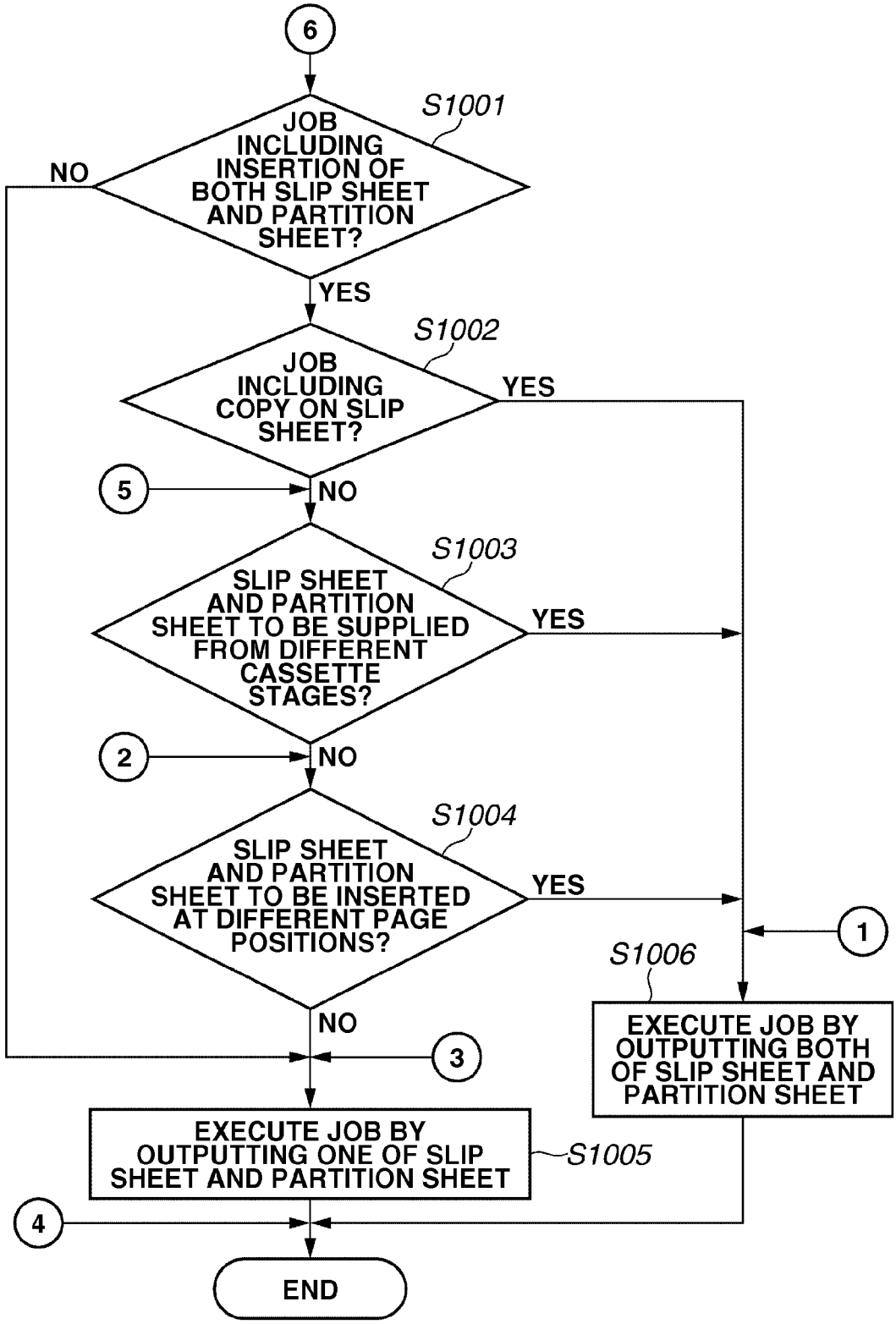
FIG. 12 is a flowchart illustrating further example processing for executing a job including a setting of adding the slip sheet and the partition sheet to the output product at the same page position according to the second exemplary embodiment of the present invention.

FIGS. 11 and 12 are flowcharts illustrating example processing performed according to the second exemplary embodiment of the present invention. A step performing processing that is similar to that of a step in the flowchart illustrated in FIG. 10 is denoted by the same step number, and part of its description is omitted. To execute the processing of the flowcharts illustrated in FIGS. 11 and 12, the CPU 402 of the controller 102 reads a program from the ROM 404 and executes the read program.

Figure 13:
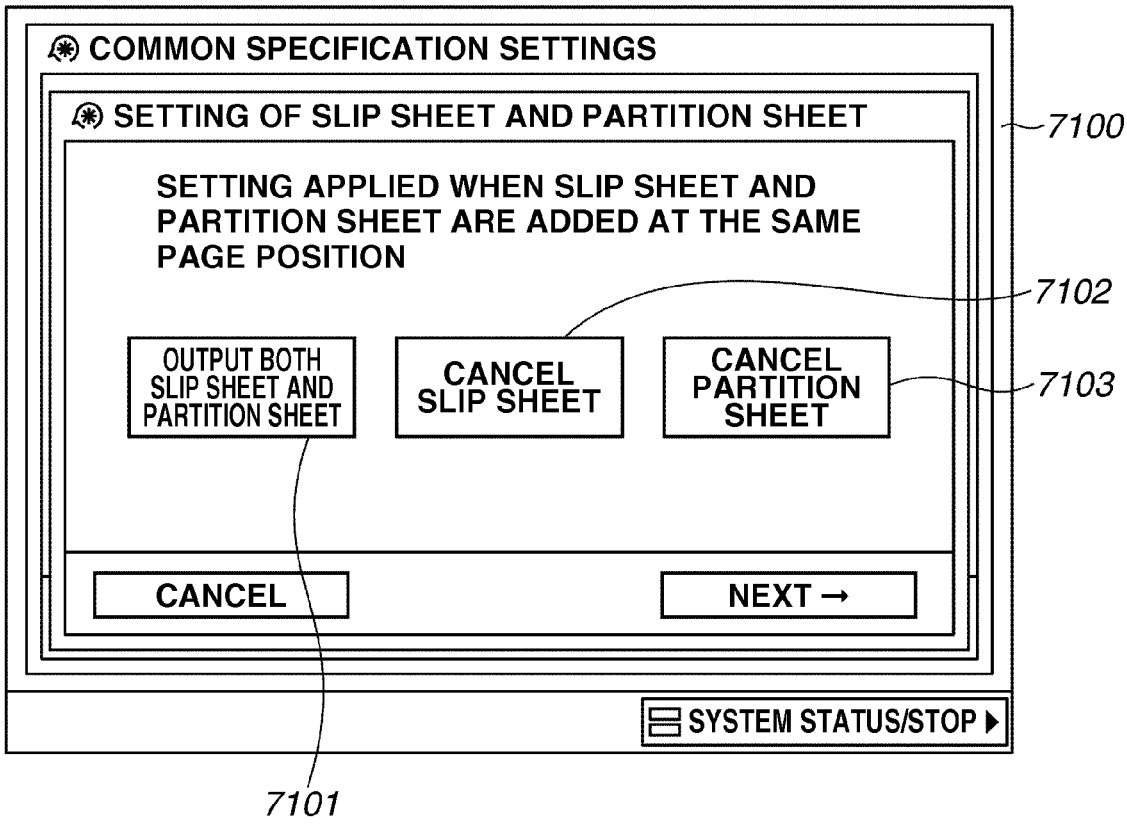
FIG. 13 illustrates an example of a setting screen that enables users to set a method for outputting the slip sheet and the partition sheet.

If the controller 102 determines that the job to be executed includes the setting of adding both the slip sheet and the partition sheet to the output product at the same page position, the controller 102 may start the example processing of the flowchart illustrated in FIG. 11. In step S1101, the controller 102 displays a setting screen on the touch panel 505, which enables users to select a method for outputting the slip sheet and the partition sheet. FIG. 13 illustrates an example of a setting screen 7100. When the job includes the setting of adding both the slip sheet and the partition sheet to the output product at the same page position, a user can set a method for outputting the slip sheet and the partition sheet on the example of the setting screen 7100 illustrated in FIG. 13.

If the user selects an "output both slip sheet and partition sheet" button 7101 on the setting screen 7100 (YES in step S1102), the processing proceeds to step S1006 of FIG. 12. In step S1006, the controller 102 executes the job by outputting both the slip sheet and the partition sheet even if the job includes the setting of adding the slip sheet and the partition sheet to the output product at the same page position, and processing is ended.

If the user selects a "cancel slip sheet" button 7102 on the setting screen 7100 (NO in step S1102 and YES in step S1103), the processing proceeds to step S1108. In step S1108, the controller 102 determines whether the job to be executed includes the setting of adding both the slip sheet and the partition sheet to the output product.

If the controller 102 determines that the job does not include the setting of adding both the slip sheet and the partition sheet to the output product (NO in step S1108), the processing proceeds to step S1005 of FIG. 12. In step S1005, the controller 102 cancels the slip sheet setting and executes the job by outputting only the partition sheet, and processing is ended. As described above, when the job to be executed includes the setting of adding both the slip sheet and the partition sheet to the output product at the same page position, the controller 102 cancels the slip sheet setting and executes the job by outputting only the partition sheet.

If the controller 102 determines that the job includes the setting of adding both the slip sheet and the partition sheet to the output product (YES in step S1108), the processing proceeds to step S1004 of FIG. 12. In step S1004, the controller 102 determines whether the slip sheet and the partition sheet are added to the output product at different page positions. If the controller 102 determines that the slip sheet and the partition sheet are added to the output product at different page positions (YES in step S1004), the processing proceeds to step S1006, where the job is executed by outputting both the slip sheet and the partition sheet, and processing is then ended. If the controller 102 determines that the slip sheet and the partition sheet are added to the output product at the same page position (NO in step S1004), the processing proceeds to step S1005, where the job is executed by outputting one of the slip sheet and partition sheet, and processing is ended.

Figure 14:
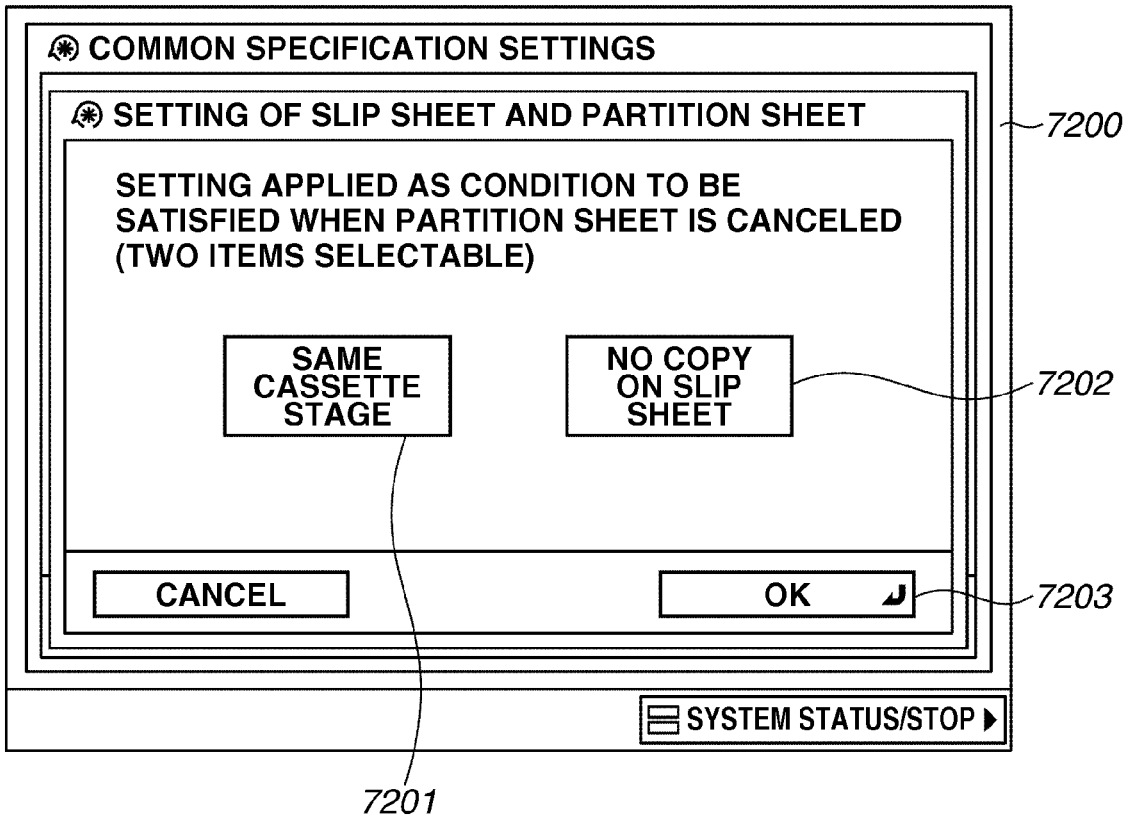
FIG. 14 illustrates an example of a setting screen that enables users to select a condition to be satisfied to cancel the partition sheet.

If the user selects a "cancel partition sheet" button 7103 on the setting screen 7100, the determination results in steps S1102 and S1103 are both NO and the determination result in step S1104 is YES (NO in step S1102 and step S1103, and YES in step S1104.) Processing then proceeds to step S1105. Thus, in step S1105, the controller 102 displays a setting screen on the touch panel 505, which enables users to select a condition to be satisfied to cancel the partition sheet. FIG. 14 illustrates an example of a setting screen that may be displayed in this case. A user can designate a method for outputting the slip sheet and the partition sheet on the setting screen 7200 illustrated in FIG. 14, when the slip sheet and the partition sheet are fed from the same cassette stage, and if the job does not include any setting of copy (e.g., print) on the slip sheet. In this case, the user can select both a "same cassette stage" button 7201 and a "no copy on slip sheet" button 7202 on the setting screen 7200. If the user does not select "output both slip sheet and partition sheet" (NO in step S1102), and also does not select "cancel slip sheet" or "cancel partition sheet" (NO in step S1103 and step S1104), for example if the user selects "cancel" on the setting screen 7200, then processing may be ended.

If the user selects only the "same cassette stage" button 7201 on the setting screen 7200 (YES in step S1106 and NO in step S1107), the processing proceeds to step S1109. In step S1109, the controller 102 determines whether the job to be executed includes the setting of adding both the slip sheet and the partition sheet to the output product. If the controller 102 determines that the job to be executed does not include any setting of adding both the slip sheet and the partition sheet to the output product (NO in step S1109), the processing proceeds to step S1005 in which the controller 102 cancels the partition sheet setting and executes the job by outputting only the slip sheet, after which processing is ended.

If the controller 102 determines that the job to be executed includes the setting of adding both the slip sheet and the partition sheet to the output product (YES in step S1109), the processing proceeds to step S1003. As described above, in step S1003, the controller 102 determines whether the slip sheet and the partition sheet are fed from different cassette stages (i.e., storage places). In the determination processing in step S1003, the storage places are not limited to the cassettes 318, and can also include paper feeding stages of the paper feeding deck 314 and a manual tray.

If the controller 102 determines that the slip sheet and the partition sheet are fed from different cassette stages (YES in step S1003), the processing proceeds to step S1006, where the job is executed by outputting both of the slip sheet and the partition sheet, and then processing is ended. If the controller 102 determines that the slip sheet and the partition sheet are fed from the same cassette stage (NO in step S1003), the controller 102 performs the processing of step S1004. If the controller 102 determines that the slip sheet and the partition sheet are added to the output product at the same page position (NO in step S1004), the processing proceeds to step S1005, where the job is executed by outputting one of the slip sheet and partition sheet, and processing is ended. If the controller 102 determines that the slip sheet and the partition sheet are to be inserted at different positions (YES in step S1004), the processing proceeds to step S1006, where the job is executed by outputting both the slip sheet and partition sheet, and processing is then ended.

If the user selects only the "no copy on slip sheet" button 7202 on the setting screen 7200 (NO in step S1106 and YES in step S1110), the processing proceeds to step S1111. In step S1111, the controller 102 determines whether the job to be executed includes the setting of adding both the slip sheet and the partition sheet to the output product. If the controller 102 determines that the job does not include any setting of adding both the slip sheet and the partition sheet to the output product (NO in step S1111), the processing proceeds to step S1005 in which the controller 102 cancels the partition sheet setting and executes the job by outputting only the slip sheet, after which processing is ended.

If the job includes the setting of adding both the slip sheet and the partition sheet to the output product (YES in step S1111), the processing proceeds to step S1112. Similar to step S1002, in step S1112, the controller 102 determines whether the job to be executed is a job including a copy (e.g., print) on the slip sheet. If the controller 102 determines that the job includes the copy (e.g., print) on the slip sheet (YES in step S1112), the processing proceeds to step S1006, where the job is executed by outputting both the slip sheet and the partition sheet, and processing is ended. If the controller 102 determines that the job does not include any copy (e.g., print)

on the slip sheet (NO in step S1112), the controller 102 performs the processing of step S1004, and the steps subsequent to step S1004 as described above. If the controller 102 determines that the slip sheet and the partition sheet are added to the output product at the same page position (NO in step S1004), the processing proceeds to step S1005, where the job is executed by outputting one of the slip sheet and partition sheet, and processing is ended. If the controller 102 determines that the slip sheet and partition sheet are inserted at different positions (YES in step S1004), processing proceeds to step S1006 where the job is executed by outputting both the slip sheet and the partition sheet, and processing is ended.

If the user selects both the "same cassette stage" button 7201 and the "no copy on slip sheet" button 7202 on the setting screen 7200 (YES in step S1106 and YES in step S1107), the controller 102 performs the processing of step S1001 and subsequent steps illustrated in FIG. 12, which is similar to the processing described above with reference to FIG. 10. Namely, the controller 102 cancels the partition sheet setting and outputs only the slip sheet when the job includes the setting of inserting both the slip sheet and the partition sheet and performing a copy on the slip sheet, and if the partition sheet and the slip sheet are fed from the same cassette stage, and when the insertion position of the partition sheet is identical to the insertion position of the slip sheet.

If the user selects an "OK" button 7203 on the setting screen 7200 without selecting any other buttons (NO in step S1106 and NO in step S1110), the controller 102 performs the processing of step S1004 and the subsequent steps as described above. If the controller 102 determines that the slip sheet and the partition sheet are added to the output product at the same page position (NO in step S1004), the processing proceeds to step S1005 in which the controller 102 cancels the partition sheet setting and executes the job by outputting only the slip sheet regardless of the slip sheet setting, after which processing is ended. If the controller 102 determines that the slip sheet and the partition sheet are to be inserted at different positions (YES in step S1004), the processing proceeds to step S1006 where the job is executed by outputting both of the slip sheet and partition sheet, after which processing is ended.

According to the above-described second exemplary embodiment, when the slip sheet and the partition sheet are added to the output product at the same page position, insertion of either the slip sheet or the partition sheet can be canceled based on an output method selected by a user. Thus, in addition to the effects of the above-described first exemplary embodiment, the second exemplary embodiment can relatively easily obtain the output product according to user's intent.

An image forming apparatus according to the third exemplary embodiment of the present invention is similar to the image forming apparatuses described in first exemplary embodiment in their configurations (e.g., refer to FIGS. 1 to 6). Constituent components and portions similar to those described in the first and second exemplary embodiments are denoted by the same reference numerals, and their descriptions are not repeated.

The multifunction peripheral 100 according to the above-described first and second exemplary embodiment is capable of automatically canceling the partition sheet setting when the job includes the setting of adding the slip sheet and the partition sheet at the same page position (i.e., the same insertion position), under the predetermined conditions that no print is performed on the slip sheet and the slip sheet and the partition sheet are fed from different storage places.

However, it may be that a user may want to leave some of the pages to be automatically deleted. Hence, the multifunction peripheral 100 according to the third exemplary embodiment inquires with a user about cancellation of the partition sheet, when the above-described predetermined conditions are satisfied.

Figure 15:
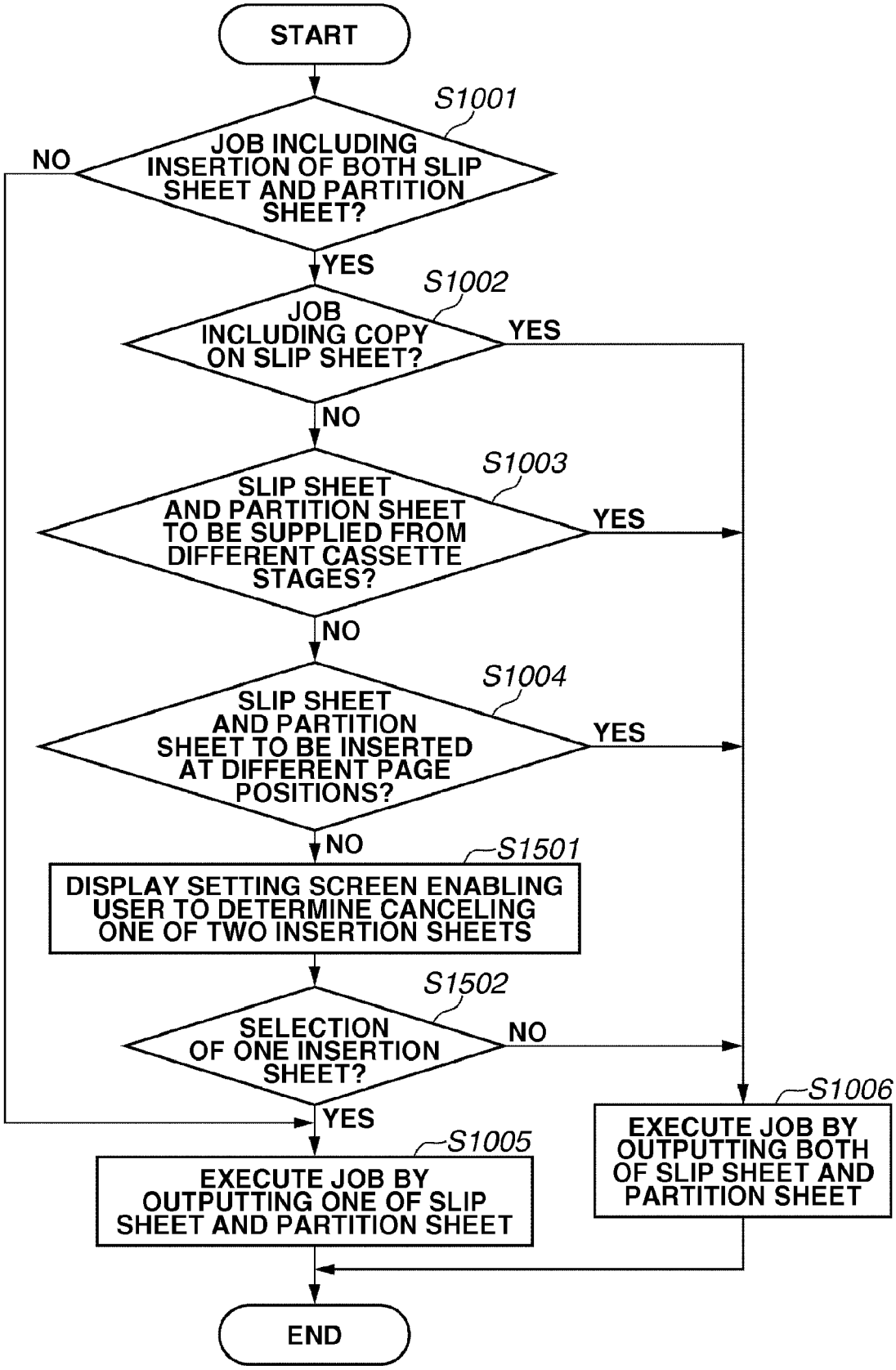
FIG. 15 is a flowchart illustrating example processing for executing a job including a setting of adding the slip sheet and the partition sheet to an output product at the same page position according to a third exemplary embodiment of the present invention.
Figure 16:
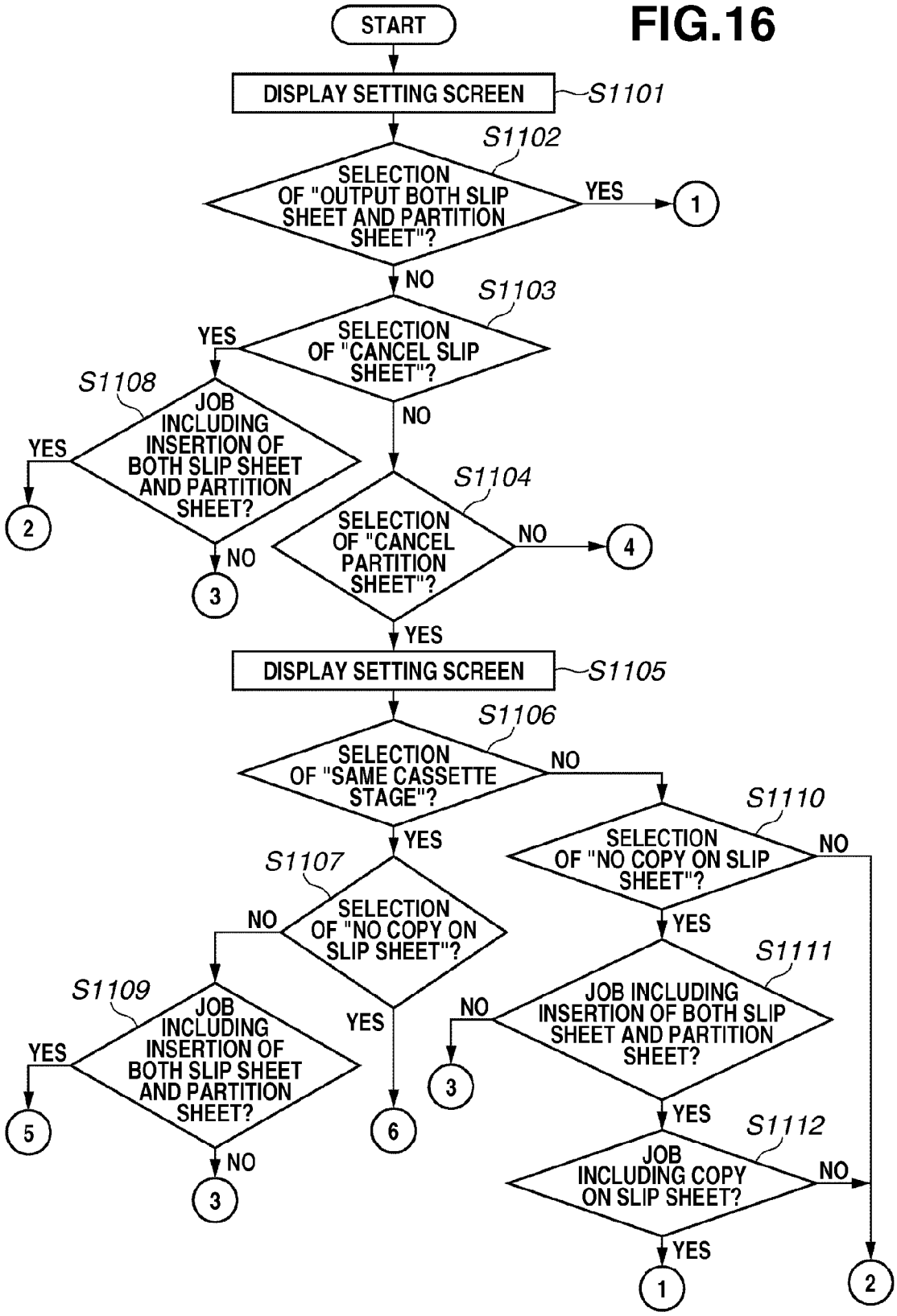
FIG. 16 is a flowchart illustrating example processing for executing the job including the setting of adding the slip sheet and the partition sheet to the output product at the same page position according to the third exemplary embodiment of the present invention.
Figure 17:
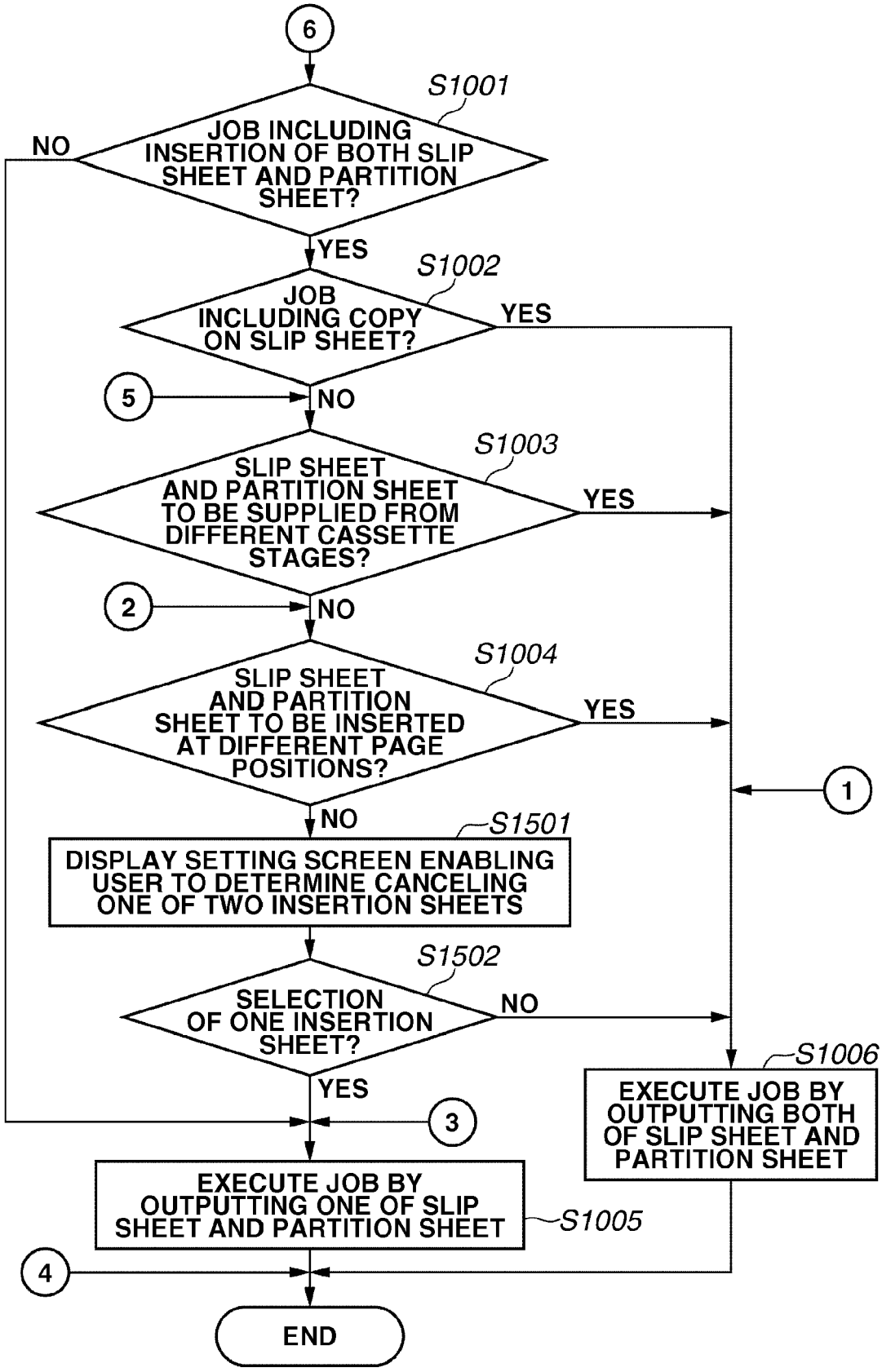
FIG. 17 is a flowchart illustrating further example processing for executing the job including the setting of adding the slip sheet and the partition sheet to the output product at the same page position according to the third exemplary embodiment of the present invention.

FIGS. 15 to 17 are flowcharts illustrating example processing for executing a job including a setting of adding the slip sheet and the partition sheet to an output product at the same page position according to the third exemplary embodiment of the present invention. To execute the example processing of the flowcharts illustrated in FIGS. 15 to 17, the CPU 402 of the controller 102 reads a program from the ROM 404 and executes the read program. In FIGS. 15 and 17, processing of steps S1001 to S1006 is similar to the processing of steps S1001 to S1006 illustrated in FIG. 10. In FIG. 16, processing of steps S1101 to S1112 is similar to the processing of steps S1101 to S1112 in FIG. 11. Therefore, their descriptions are not repeated.

According to this example, if the controller 102 determines that the slip sheet and the partition sheet are added to the output product at the same page position (NO in step S1004), the processing proceeds to step S1501. In step S1501, the controller 102 displays a pop-up setting screen on the touch panel 505, an example of which is illustrated in FIG. 18, which enables a user to determine whether to cancel the partition sheet (i.e., one of two insertion sheets).

Figure 18:
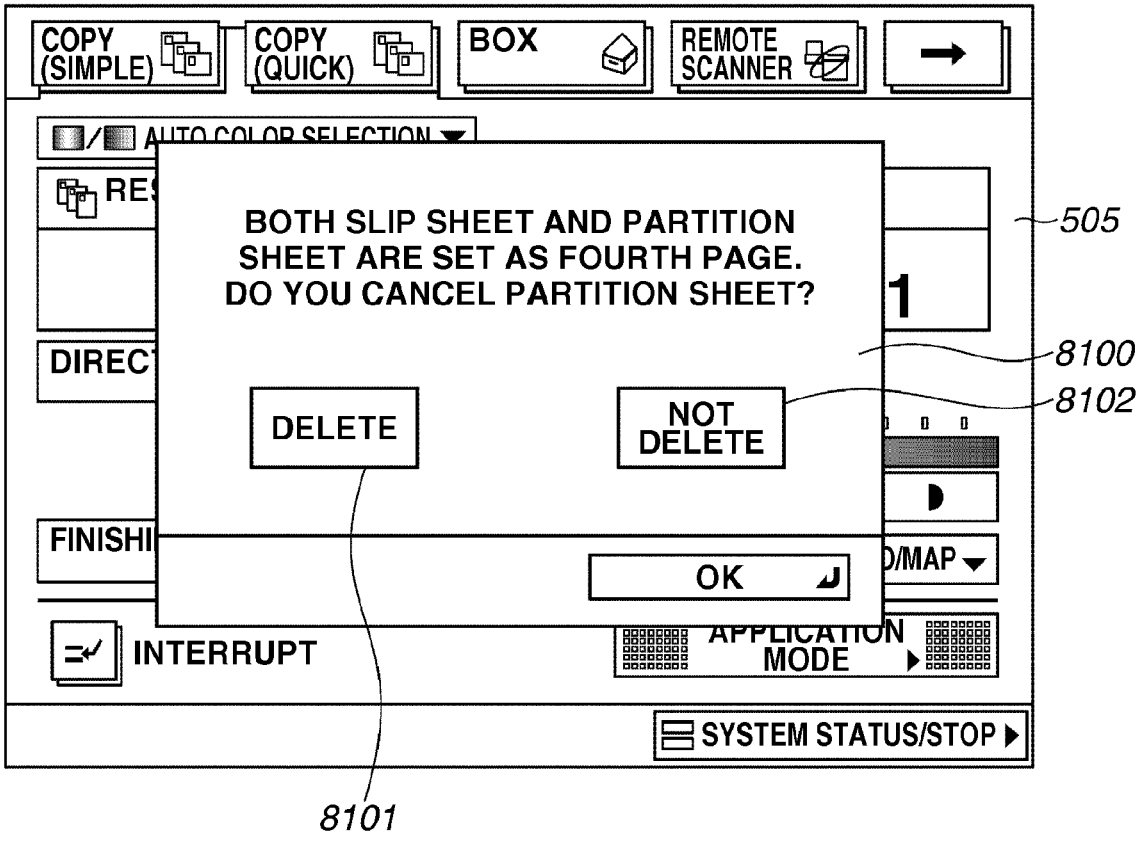
FIG. 18 illustrates an example of a setting screen that enables users to determine whether to cancel one of insertion sheets.

If the user selects a "delete" button 8101 on the setting screen 8100 illustrated in FIG. 18 (YES in step S1502), the processing proceeds to step S1005 in which the controller 102 cancels the partition sheet setting and executes the job by outputting only the slip sheet, after which processing is ended. If the user selects a "not delete" button 8102 on the setting screen 8100 (NO in step S1502), the processing proceeds to step S1006 in which the controller 102 executes the job by outputting both the slip sheet and the partition sheet, after which processing is ended.

Thus, in addition to the effects of the above-described first and second exemplary embodiments, the third exemplary embodiment may be capable of relatively easily obtaining the output product according to user's intent.

The functional operation described in the above-described first to third exemplary embodiments is a copy job performed by the multifunction peripheral 100. However, a similar functional operation can also be performed, for example, on a job entered from the PC 108 to the multifunction peripheral 100 via the network 106.

Figure 19:
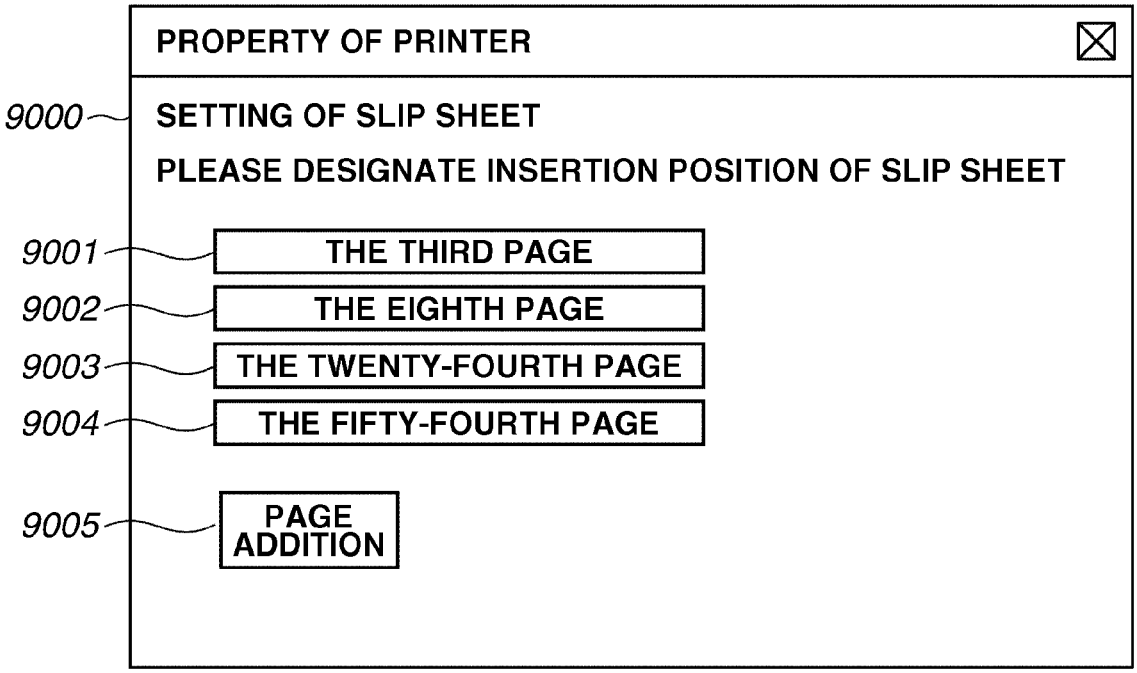
FIG. 19 illustrates an example of a property screen to be displayed when users perform output setting for the slip sheet using a printer driver installed on a personal computer (PC).

FIG. 19 illustrates an example of a property screen to be displayed when users perform output setting for the slip sheet using a printer driver installed on the PC 108.

When the printer driver of the PC 108 displays the property screen illustrated in FIG. 19 on a monitor of the PC 108, a user can input page numbers in respective setting tabs 9001, 9002, 9003, and 9004, to set page positions where the slip sheets are to be inserted. The user can press a "page addition" button 9005 to add a setting tab to be used to input page positions where the slip sheets are inserted.

If the setting includes adding the partition sheet at any one of the page positions of the slip sheet having been set in the setting tabs 9001 to 9004, the method for outputting the slip sheet and the partition sheet can be determined in detail, as described for example in the first to third exemplary embodiments.

Figure 20:
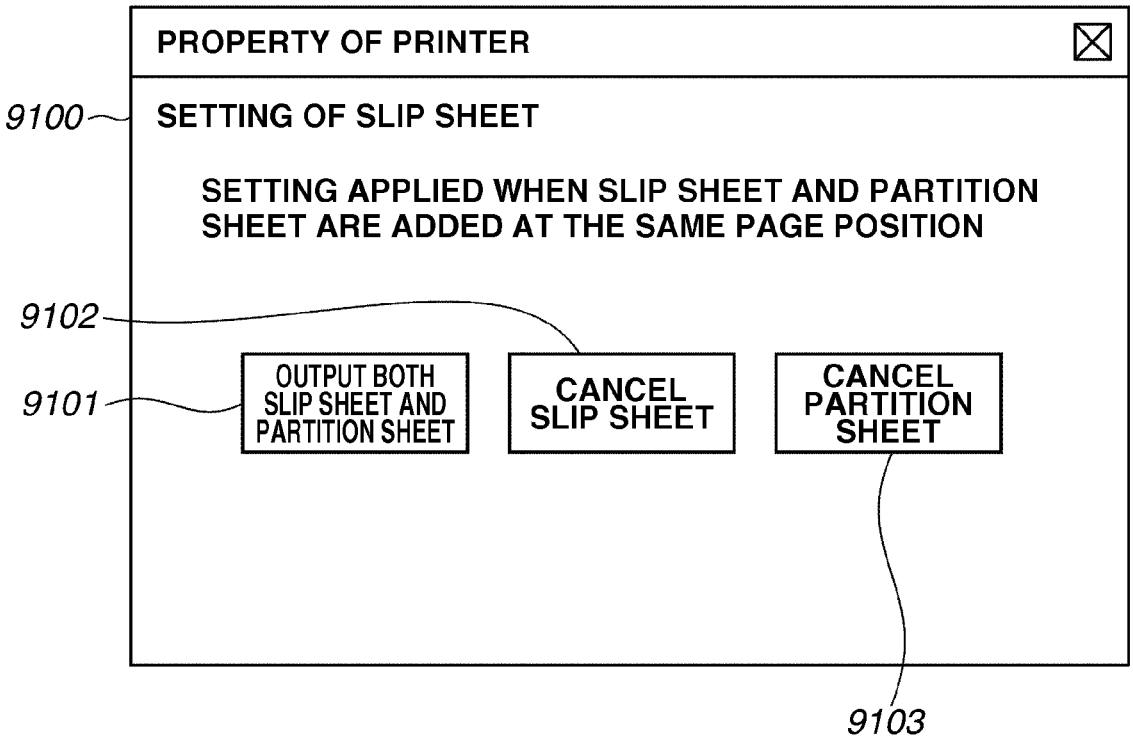
FIG. 20 illustrates an example of a setting screen that enables users to determine a method for outputting the slip sheet and the partition sheet using the printer driver of the PC.

FIG. 20 illustrates an example of a setting screen that enables users to determine a method for outputting the slip sheet and the partition sheet using the printer driver of the PC 108.

In the example of the setting screen 9100 illustrated in FIG. 20, an "output both slip sheet and partition sheet" button 9101 has a function corresponding to that of the "output both slip sheet and partition sheet" button 7101 illustrated in the example of FIG. 13. A "cancel slip sheet" button 9102 has a function corresponding to that of the "cancel slip sheet" button 7102 illustrated in the example of FIG. 13. A "cancel partition sheet" button 9103 has a function corresponding to that of the "cancel partition sheet" button 7103 illustrated in the example of FIG. 13.

Figure 21:
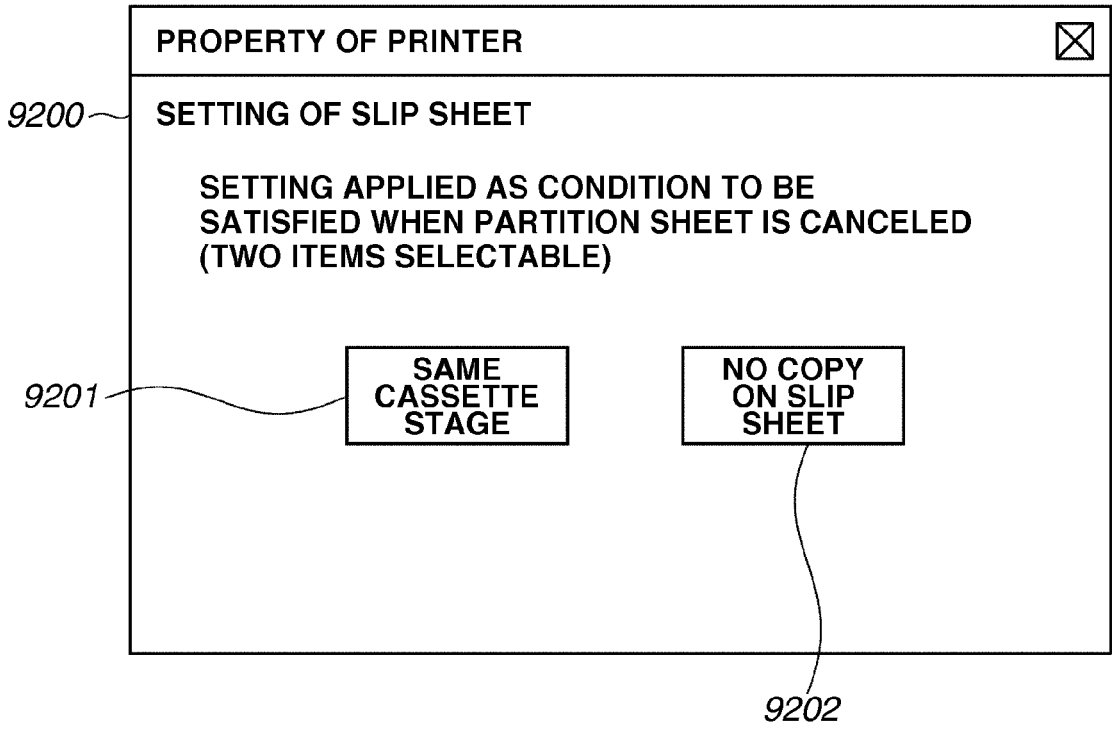
FIG. 21 illustrates an example of a setting screen that enables users to select a condition to be satisfied to cancel the partition sheet using the printer driver of the PC.

FIG. 21 illustrates an example setting screen that enables users to select a condition to be satisfied to cancel the partition sheet using the printer driver of the PC 108.

In the setting screen 9200 illustrated in FIG. 21, a "same cassette stage" button 9201 has a function corresponding to that of the "same cassette stage" button 7201 illustrated in the example of FIG. 14, and a "no copy on slip sheet" button 9202 has a function corresponding to that of the "no copy on slip sheet" button 7202 illustrated in the example of FIG. 14.

According to the above-described fourth exemplary embodiment, even when a job is input from the PC to the multifunction peripheral via the network, the function operations of the above-described first to third exemplary embodiments can be used, and a user's usability can be improved.

The following is example of operations that may be performed according to the above-described exemplary embodiments. For example, in one version the slip sheet may be inserted as a first insertion sheet in a plurality of sheets to be output by the multifunction peripheral 100. The partition sheet may inserted also be inserted in this version as a second insertion sheet in the plurality of sheets to be output by the multifunction peripheral 100. In this version, the multifunction peripheral 100 may perform the control capable of preventing the slip sheet and the partition sheet from being added to the plurality of sheets at the same insertion position.

According to one embodiment, the multifunction peripheral 100 performs a first determination to determine whether the setting for the slip sheet or the partition sheet includes formation of an image. If there is the setting for forming an image on the slip sheet or the partition sheet, the multifunction peripheral 100 permits users to add the slip sheet and the partition sheet to a plurality of sheets at the same insertion position. The multifunction peripheral 100 further performs a second determination to determine whether the cassette (paper feeding source) of the slip sheet is identical to the paper feeding unit (paper feeding source) of the partition sheet.

If it is determined that the compared paper feeding sources are the same, the multifunction peripheral 100 performs the control capable of preventing the slip sheet and the partition sheet from being added to the plurality of sheets at the same insertion position. Moreover, instead of determining whether the paper feeding sources are identical with each other, the multifunction peripheral 100 may also or alternatively perform a third determination to determine whether the size of the slip sheet is identical to the size of the partition sheet. If it is determined that the compared sheet sizes are the same, the multifunction peripheral 100 may perform the control capable of preventing the slip sheet and the partition sheet from being added to the plurality of sheets at the same insertion position.

Aspects of the present invention can be attained by executing the following processing. For example, at least one of a software program code and computer executable instructions for realizing the functions of the above-described exemplary embodiments may be installable to a system or an apparatus via a storage medium. A computer (or CPU or micro-processing unit (MPU)) in the system or the apparatus can read the program and/or instructions from the storage medium. In this case, the program code itself read out of the storage medium can realize functions according to the above-described exemplary embodiments. Accordingly, aspects of the present invention may encompass program code and/or computer-executable instructions and a storage medium storing the program code and/or computer-executable instructions.

The storage medium supplying code can be selected from any one or more of a floppy disk, a hard disk, an optical disk, a magneto-optical (MO) disk, a compact disc-ROM (CD-ROM), a CD-recordable (CD-R), a CD-rewritable (CD-RW), a digital versatile disk (DVD)-ROM, a DVD-RAM, a DVD-RW, a DVD+RW, a magnetic tape, a nonvolatile memory card, and a ROM. In one version, the program code can be downloaded via a network.

When a computer reads and executes the program code and/or computer-executable instructions, the computer can realize functions according to aspects of the above-described exemplary embodiments. Moreover, an operating system (OS) or other application software running on a computer can execute part or all of actual processing based on the instructions and/or the program code, to realize functions according to aspects of the above-described exemplary embodiments.

Embodiments of the present invention may include cases when the functions of the above-described exemplary embodiments can be realized by the following processing. For example, the program code read out of a storage medium can be written into a memory of a function expansion board equipped in a computer or into a memory of a function expansion unit connected to the computer. In this case, based on the instructions and/or the program, a CPU provided on the function expansion board or the function expansion unit can execute part or all of the processing to realize functions according to aspects of the above-described exemplary embodiments.

When a computer reads and executes the computer-executable instructions and/or program code, the computer can realize functions according to aspects of the above-described exemplary embodiments. Additionally, an operating system (OS) or other application software running on a computer can execute part or all of actual processing based on the instructions and/or the program code, to realize functions according to aspects of the above-described exemplary embodiments. In one version, the above-described computer-executable instructions and/or program can be, for example, directly supplied from a storage medium storing the program, or can also be downloaded from another computer or a database via one or more of the Internet, a commercial network, and a local area network.

According to aspects of the above-described exemplary embodiments, the multifunction peripheral is operable as an electrophotographic printing apparatus. However, the present invention is not limited to electrophotographic devices. Aspects of the present invention can also be applied to, for example, at least one of an inkjet printing apparatus, a heat transfer printing apparatus, a thermal printing apparatus, an electrostatic printing apparatus, and a discharge breakdown printing apparatus.

Furthermore, the type of the above-described computer-executable instructions and/or program code can be any one or more of object code, interpreter program code, and OS script data.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-061147 filed Mar. 11, 2008, which is hereby incorporated by reference herein in its entirety.

What is claimed is:

1. An image forming apparatus including an image forming unit to form an image on a sheet, the image forming apparatus comprising:

a sheet inserting unit configured to inset one or more of a first insertion sheet and a second insertion sheet at one or more predetermined insertion positions in a plurality of sheets, in a case where the plurality of sheets are output by the image forming unit;

a control unit configured to control the sheet inserting unit to prevent the sheet inserting unit from inserting both the first insertion sheet and the second insertion sheet at the same predetermined insertion position in the plurality of sheets; and a first determining unit configured to determine whether an image is formed on the first insertion sheet by the image forming unit, wherein the control unit is configured to permit the sheet inserting unit to insert the first insertion sheet and the second insertion sheet at the same predetermined insertion position in the plurality of sheets, in a case where the first determining unit determines that the image is formed on the first insertion sheet, and prevent the sheet inserting unit from inserting the first insertion sheet and the second insertion sheet at the same predetermined insertion position in the plurality of sheets, in a case where the first determining unit determines that the image is not formed on the first insertion sheet.

2. The image forming apparatus according to claim 1, further comprising:

a second determining unit configured to determine whether a paper feeding source of the first insertion sheet is identical to a paper feeding source of the second insertion sheet, wherein the control unit is configured to control the sheet inserting unit to prevent the sheet inserting unit from inserting both the first insertion sheet and the second insertion sheet at the same predetermined insertion position in the plurality of sheets, in a case where the second determining unit determines that the paper feeding source of the first insertion sheet is identical to the paper feeding source of the second insertion sheet.

3. An image forming apparatus including an image forming unit to form an image on a sheet, the image forming apparatus comprising:

a sheet inserting unit configured to insert one or more of a first insertion sheet and a second insertion sheet at one or more predetermined insertion positions in a plurality of sheets, in a case where the plurality of sheets are output by the image forming unit;

a control unit configured to control the sheet inserting unit to prevent the sheet inserting unit from inserting both the first insertion sheet and the second insertion sheet at the same predetermined insertion position in the plurality of sheets; and a first determining unit configured to determine whether a sheet size of the first insertion sheet is identical to a sheet size of the second insertion sheet, wherein the control unit is configured to control the sheet inserting unit to prevent the sheet inserting unit from inserting both the first insertion sheet and the second insertion sheet at the same predetermined insertion position in the plurality of sheets, in a case where the first determining unit determines that the sheet size of the first insertion sheet is identical to the sheet size of the second insertion sheet.

4. The image forming apparatus according to claim 1, further comprising:

a specifying unit configured to specify an insertion position of the first insertion sheet and an insertion position of the second insertion sheet performed by the sheet inserting unit in the plurality of sheets; and a setting unit configured to perform a setting for preventing either the first insertion sheet or the second insertion sheet from being inserted, in a case where the specifying unit specifies the insertion position of the first insertion sheet and the insertion position of the second insertion sheet as being the same predetermined insertion position in the plurality of sheets, wherein the control unit is configured to control the sheet inserting unit to prevent the sheet inserting unit from inserting both the first insertion sheet and the second insertion sheet at the same predetermined insertion position of the plurality of sheets, based on the setting by the setting unit.

5. The image forming apparatus according to claim 1, wherein the first insertion sheet is a slip sheet and the second insertion sheet is a partition sheet.

6. A control method for controlling an image forming apparatus including an image forming unit to form an image on a sheet, the method comprising:

inserting one or more of a first insertion sheet and a second insertion sheet at one or more predetermined insertion positions in a plurality of sheets, in a case where the plurality of sheets are output by the image forming unit;

controlling insertion of one or more of the first insertion sheet and the second insertion sheet to prevent insertion of both the first insertion sheet and the second insertion sheet at the same predetermined insertion position in the plurality of sheets;

determining whether the image forming unit forms an image on the first insertion sheet; and permitting insertion of the first insertion sheet and the second insertion sheet at the same predetermined insertion position in the plurality of sheets, in a case where it is determined that the image forming unit forms the image on the first insertion sheet, and preventing insertion of the first insertion sheet and the second insertion sheet at the same predetermined insertion position in the plurality of sheets, in a case where it is determined that the image forming unit does not form the image on the first insertion sheet.

7. The control method according to claim 6, further comprising:

determining whether a paper feeding source of the first insertion sheet is identical to a paper feeding source of the second insertion sheet; and controlling insertion of one or more of the first insertion sheet and the second insertion sheet to prevent insertion of both the first insertion sheet and the second insertion sheet at the same predetermined insertion position in the plurality of sheets, in a case where it is determined that the paper feeding source of the first insertion sheet is identical to the paper feeding source of the second insertion sheet.

8. A control method for controlling an image forming apparatus including an image forming unit to form an image on a sheet, the method comprising:

inserting one or more of a first insertion sheet and a second insertion sheet at one or more predetermined insertion positions in a plurality of sheets, in a case where the plurality of sheets are output by the image forming unit;

controlling insertion of one or more of the first insertion sheet and the second insertion sheet to prevent insertion of both the first insertion sheet and the second insertion sheet at the same predetermined insertion position in the plurality of sheets;

determining whether a sheet size of the first insertion sheet is identical to a sheet size of the second insertion sheet; and controlling insertion of one or more of the first insertion sheet and the second insertion sheet to prevent insertion of both the first insertion sheet and the second insertion sheet at the same predetermined insertion position in the plurality of sheets, in a case where it is determined that the sheet size of the first insertion sheet is identical to the sheet size of the second insertion sheet.

9. The control method according to claim 6, further comprising:

specifying an insertion position of the first insertion sheet and an insertion position of the second insertion sheet in the plurality of sheets;

performing a setting for preventing either the first insertion sheet or the second insertion sheet from being inserted, in a case where the insertion positions of the first insertion sheet and the second insertion sheet are specified as being the same predetermined insertion position in the plurality of sheets; and controlling insertion of one or more of the first insertion sheet and the second insertion sheet to prevent insertion of both the first insertion sheet and the second insertion sheet at the same predetermined insertion position, based on the setting performed.

10. The control method according to claim 6, wherein the first insertion sheet is a slip sheet and the second insertion sheet is a partition sheet.

11. A non-transitory computer-readable storage medium having computer-executable instructions stored thereon that are capable of being executed by a computer for controlling an image forming apparatus including an image forming unit to form an image on a sheet, the computer-readable storage medium comprising:

computer-executable instructions to insert one or more of a first insertion sheet and a second insertion sheet at one or more predetermined positions in a plurality of sheets, in a case where the plurality of sheets are output by the image forming unit;

computer-executable instructions to control insertion of one or more of the first insertion sheet and the second insertion sheet to prevent insertion of both the first insertion sheet and the second insertion sheet at the same predetermined insertion position in the plurality of sheets;

computer-executable instructions to determine whether the image forming unit forms an image on the first insertion sheet; and computer-executable instruction to permit insertion of the first insertion sheet and the second insertion sheet at the same predetermined insertion position in the plurality of sheets, in a case where it is determined that the image forming unit forms the image on the first insertion sheet, and prevent insertion of the first insertion sheet and the second insertion sheet at the same predetermined insertion position in the plurality of sheets, in a case where it is determined that the image forming unit does not form the image on the first insertion sheet.

12. A non-transitory computer-readable storage medium having computer-executable instructions stored thereon that are capable of being executed by a computer for controlling an image forming apparatus including an image forming unit to form an image on a sheet, the computer-readable storage medium comprising:

computer-executable instructions to insert one or more of a first insertion sheet and a second insertion sheet at one or more predetermined positions in a plurality of sheets, in a case where the plurality of sheets are output by the image forming unit;

computer-executable instructions to control insertion of one or more of the first insertion sheet and the second insertion sheet to prevent insertion of both the first insertion sheet and the second insertion sheet at the same predetermined insertion position in the plurality of sheets;

computer-executable instructions to determine whether a sheet size of the first insertion sheet is identical to a sheet size of the second insertion sheet; and computer-executable instructions to control insertion of one or more of the first insertion sheet and the second insertion sheet to prevent insertion of both the first insertion sheet and the second insertion sheet at the same predetermined insertion position in the plurality of sheets, in a case where it is determined that the sheet size of the first insertion sheet is identical to the sheet size of the second insertion sheet.

* * * * *